US011387015B2

(12) United States Patent
Fukushima et al.

(10) Patent No.: US 11,387,015 B2
(45) Date of Patent: Jul. 12, 2022

(54) WIRING MEMBER AND METHOD OF MANUFACTURING WIRING MEMBER

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Daichi Fukushima, Mie (JP); Koichiro Goto, Mie (JP); Junichi Shirakawa, Mie (JP); Housei Mizuno, Mie (JP); Miyu Aramaki, Mie (JP); Toru Tanji, Osaka (JP); Ryusuke Kudo, Mie (JP); Masaki Mizushita, Mie (JP); Haruka Nakano, Mie (JP); Tetsuya Nishimura, Mie (JP); Kenta Arai, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/276,586

(22) PCT Filed: Sep. 13, 2019

(86) PCT No.: PCT/JP2019/036142
§ 371 (c)(1),
(2) Date: Mar. 16, 2021

(87) PCT Pub. No.: WO2020/059663
PCT Pub. Date: Mar. 26, 2020

(65) Prior Publication Data

US 2022/0044840 A1 Feb. 10, 2022

(30) Foreign Application Priority Data

Sep. 19, 2018 (JP) ..... JP2018-175195

(51) Int. Cl.
*H01B 7/08* (2006.01)
*H01B 7/40* (2006.01)
*H01B 13/00* (2006.01)

(52) U.S. Cl.
CPC ..... *H01B 7/0846* (2013.01); *H01B 7/40* (2013.01); *H01B 13/0036* (2013.01)

(58) Field of Classification Search
CPC ..... H01B 7/0846; H01B 7/08; H01B 7/40; B60R 16/0207; B60R 16/0215
See application file for complete search history.

(56) References Cited

U.S. PATENT DOCUMENTS 3,911,201 A * 10/1975 Fry ..... H01B 7/0846 174/72 A
6,469,252 B1 10/2002 Tanaka et al.
(Continued)

FOREIGN PATENT DOCUMENTS

CN 104137359 11/2014
CN 104143387 11/2014
(Continued)

OTHER PUBLICATIONS

International Search Report, WIPO, Application No. PCT/JP2019/036142, dated Oct. 21, 2019, English translation.
(Continued)

*Primary Examiner* — Hoa C Nguyen
*Assistant Examiner* — Amol H Patel
(74) *Attorney, Agent, or Firm* — Greenblum & Bernstein, P.L.C.

(57) ABSTRACT

A wiring member includes a sheet material and a wire-like transmission member fixed on the sheet material. For example, the sheet material is considered to be made by combining a plurality of base materials to be processed to extend to regions different from each other.

16 Claims, 14 Drawing Sheets

(56) References Cited

U.S. PATENT DOCUMENTS

| | | | |
|---|---|---|---|
| 10,734,134 | B2 | 8/2020 | Mizuno et al. |
| 2003/0102148 | A1 | 6/2003 | Ohara et al. |
| 2004/0003938 | A1 | 1/2004 | Yoshida et al. |
| 2014/0332267 | A1 | 11/2014 | Tanaka et al. |
| 2015/0008012 | A1 | 1/2015 | Sasaki |
| 2016/0019998 | A1 | 1/2016 | Kawaguchi et al. |
| 2016/0036151 | A1 | 2/2016 | Tominaga et al. |
| 2018/0374605 | A1 | 12/2018 | Kawaguchi et al. |

FOREIGN PATENT DOCUMENTS

| | | | |
|---|---|---|---|
| CN | 104221478 | | 12/2014 |
| CN | 205004711 | U | 1/2016 |
| CN | 205092390 | | 3/2016 |
| CN | 207801373 | U | 8/2018 |
| CN | 209388774 | U | 9/2019 |
| EP | 0195871 | | 10/1986 |
| JP | H04-21131 | A | 2/1992 |
| JP | H07-006632 | A | 1/1995 |
| JP | H08-315823 | A | 11/1996 |
| JP | H09-063357 | A | 3/1997 |
| JP | H09-223415 | A | 8/1997 |
| JP | 2001-135156 | | 5/2001 |
| JP | 2003-112584 | A | 4/2003 |
| JP | 2004-192949 | A | 7/2004 |
| JP | 2005-135823 | A | 5/2005 |
| JP | 2011-24356 | A | 2/2011 |
| JP | 2013-37922 | A | 2/2013 |
| JP | 2017-157498 | A | 9/2017 |
| JP | 2018-85321 | A | 5/2018 |
| TW | 201351449 | | 12/2013 |
| WO | 2014/123117 | A1 | 8/2014 |

OTHER PUBLICATIONS

Written Opinion, WIPO, Application No. PCT/JP2019/036142, dated Oct. 21, 2019.

International Preliminary Report on Patentability, WIPO, Application No. PCT/JP2019/036142, dated Nov. 16, 2020, with English translation.

China Office Action issued in China patent Application No. 201980060249.2, dated Dec. 13, 2021, together with English translation thereof.

China Office Action issued in China patent Application No. 201980060249.2, dated Apr. 12, 2022, together with English translation thereof.

* cited by examiner

WIRING MEMBER AND METHOD OF MANUFACTURING WIRING MEMBER

TECHNICAL FIELD

The present disclosure relates to a wiring member and a method of manufacturing the wiring member.

BACKGROUND ART

Patent Document 1 discloses a technique of sewing an electrical wire to a sheet material to form a flat wire harness as a wiring member.

PRIOR ART DOCUMENTS

Patent Documents

Patent Document 1: Japanese Patent Application Laid-Open No. 2018-85321

SUMMARY

Problem to be Solved by the Invention

Herein, there may be a case where a sheet material is desired to be formed into a nonlinear shape. Considered as such a case is that when a wire-like transmission member such as an electrical wire is bent and disposed, the sheet material is formed into a bent shape in accordance with a route of the wire-like transmission member, for example. When the sheet material having a nonlinear shape is formed, it is considered that such a sheet material is formed by punching out a large-size parent material into the nonlinear shape directly. However, there is a possibility that a yield is reduced when the large-sized parent material is punched out into the nonlinear shape directly. Even when the sheet material is formed into a linear shape, there is a possibility that a yield is reduced depending on a length.

It is an object to provide a technique capable of increasing a yield when a sheet material where the wire-like transmission member is disposed is formed.

Means to Solve the Problem

A wiring member according to the present disclosure is a wiring member including: a sheet material made by folding one base material or combining a plurality of base materials and processing the one base material or the plurality of base materials to extend to regions different from each other; and a wire-like transmission member fixed on the sheet material.

Effects of the Invention

According to the present disclosure, a yield can be increased when a sheet material where the wire-like transmission member is disposed is formed.

DESCRIPTION OF EMBODIMENT(S)

Description of Embodiment of Present Disclosure

Figure 1:
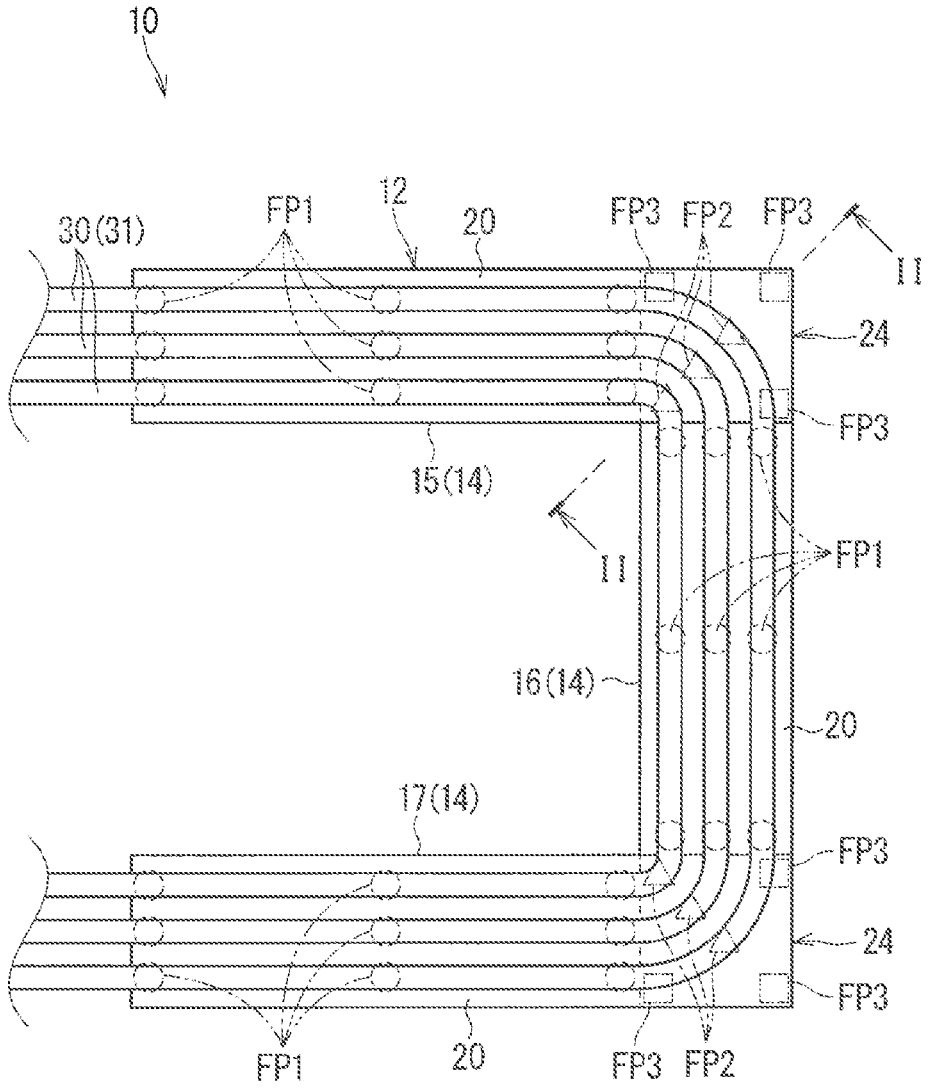
FIG. 1 is a plan view illustrating a wiring member according to a first embodiment.

Embodiments of the present disclosure are listed and described firstly.

A wiring member according to the present disclosure is as follows.

(1) A wiring member according to the present disclosure is a wiring member including: a sheet material made by folding one base material or combining a plurality of base materials and processing the one base material or the plurality of base materials to extend to regions different from each other; and a wire-like transmission member fixed on the sheet material. Accordingly, one base material is folded or the plurality of base materials are combined to extend to the regions different from each other. A base material formed into a shape having a higher yield than a shape of the sheet material such as a quadrangular shape or a band-like shape is used as this base material, thus a yield can be increased at a time of forming the sheet material where a wire-like transmission member is disposed.

(2) The sheet material may include a portion where a plurality of base materials are combined to extend to regions different from each other. Accordingly, the sheet material can be processed into a desired shape easily.

(3) The sheet material may include a portion where one base material is folded to extend to regions different from each other. Accordingly, increase in the number of base materials can be suppressed.

(4) The sheet material may include a first extension part and a second extension part formed by folding one base material or combining a plurality of base materials to be formed to extend in directions intersecting with each other. Accordingly, the sheet material having a bent part can be simply obtained.

(5) It is also applicable that the base material constituting each of the first extension part and the second extension part is formed to have directionality in a tensile strength, and the wire-like transmission member is disposed on the first extension part and the second extension part to extend along a direction in which the tensile strength of the base material is strong. Accordingly, easily suppressed is excessive force on the wire-like transmission member when the wiring member is pulled along a longitudinal direction of the wire-like transmission member.

(6) A fixing member for fixing the wiring member to a fixing target may be provided in a portion where the base material of the first extension part and the base material of the second extension part are overlapped with each other. Accordingly, suppressed is excessive force on the wire-like transmission member by reason that the wiring member is pulled in a direction in which the tensile force of the base material is strong even when a portion closer to a terminal portion side of any of the first extension part and the second extension part in relation to the fixing member in the wiring member is pulled in a state where the fixing member is fixed to a fixing target. Pulling force applied at a time when one side of one of the first extension part and the second extension part in the wiring member is pulled hardly acts on the other side thereof in the state where the fixing member is fixed to the fixing target.

(7) The wire-like transmission member may include a wire-like transmission member with a bent part bent and disposed to range from the first extension part to the second extension part. Accordingly, a yield can be increased when a sheet material where a portion in which the wire-like transmission member is bent is disposed is formed.

(8) The wire-like transmission member may include a first wire-like transmission member extending along the first extension part and a second wire-like transmission member extending along the second extension part to intersect with the first wire-like transmission member. Accordingly, a yield can be increased when a sheet material where a portion in which the wire-like transmission members intersect with each other is disposed is formed.

(9) The plurality of base materials may be combined in a portion linearly extending in the sheet material. Accordingly, a yield can be increased when a sheet material in which a linearly-extending portion is long is formed, for example.

(10) A portion where the base materials are combined may be fixed to each other. Accordingly, the base materials are hardly misaligned mutually.

(11) There may be a portion where a fixing state of a portion in which the base materials are combined and a fixing state of fixing the sheet material to the wire-like transmission member are the same as each other. Accordingly, the fixation of the base materials and the fixation of the sheet material and the wire-like transmission member can be performed using the same material or apparatus.

(12) It is also applicable that the base materials are fixed by a contact area direct fixation in a portion overlapped with each other and in the same position as this, the sheet material and the wire-like transmission member may be fixed by a contact area direct fixation. Accordingly, the fixation of the base materials and the fixation of the sheet material and the wire-like transmission member can be performed by one step.

(13) There may be a portion where a fixing state of a portion in which the base materials are combined and a fixing state of fixing the sheet material to the wire-like transmission member are different from each other. Accordingly, a fixing structure appropriate for each of the fixation of the base materials and the fixation of the sheet material and the wire-like transmission member can be adopted.

(14) A method of manufacturing a wiring member according to the present disclosure includes steps of: (a) folding one base material or combining a plurality of base materials to form a sheet material processed to extend to regions different form each other; (b) locating a wire-like transmission member on the sheet material; and (c) fixing the sheet material and the wire-like transmission member.

(15) The method of manufacturing the wiring member further includes a step of (d) fixing a portion where the base materials are overlapped with each other, wherein the step of (c) and the step of (d) may be performed by the same fixing means in the portion where the base materials are overlapped with each other. Accordingly, a lead time can be reduced in the fixation of the base materials and the fixation of the sheet material and the wire-like transmission member.

Details of Embodiment of Present Disclosure

Specific examples of a wiring member of the present disclosure are described hereinafter with reference to the drawings. The present invention is not limited to these examples, but is indicated by claims, and it is intended that meanings equivalent to claims and all modifications within a scope of claims are included.

First Embodiment

Figure 2:
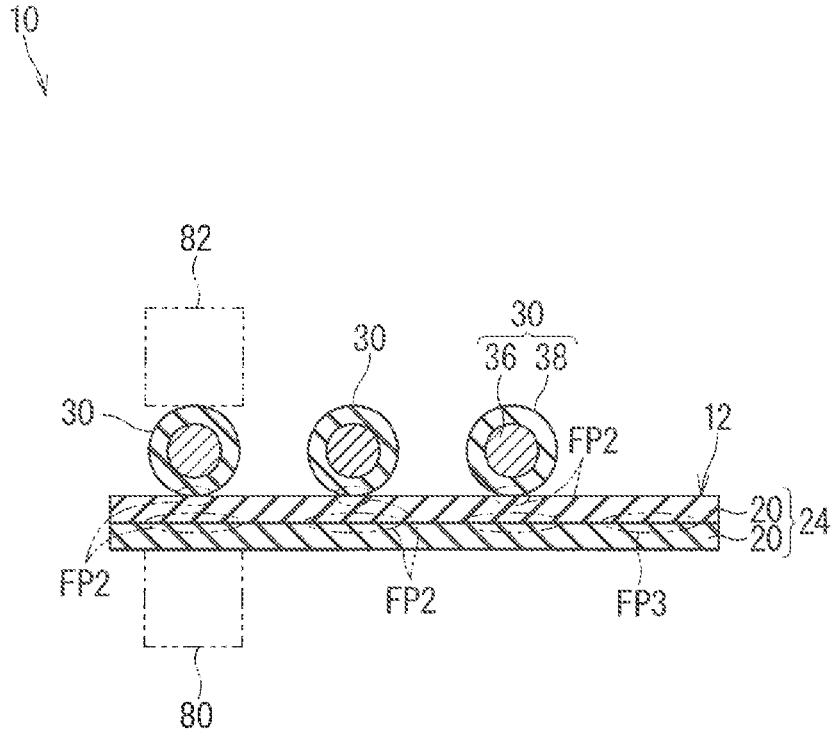
FIG. 2 is a cross-sectional view of the wiring member cut along a II-II line in FIG. 1.
Figure 3:
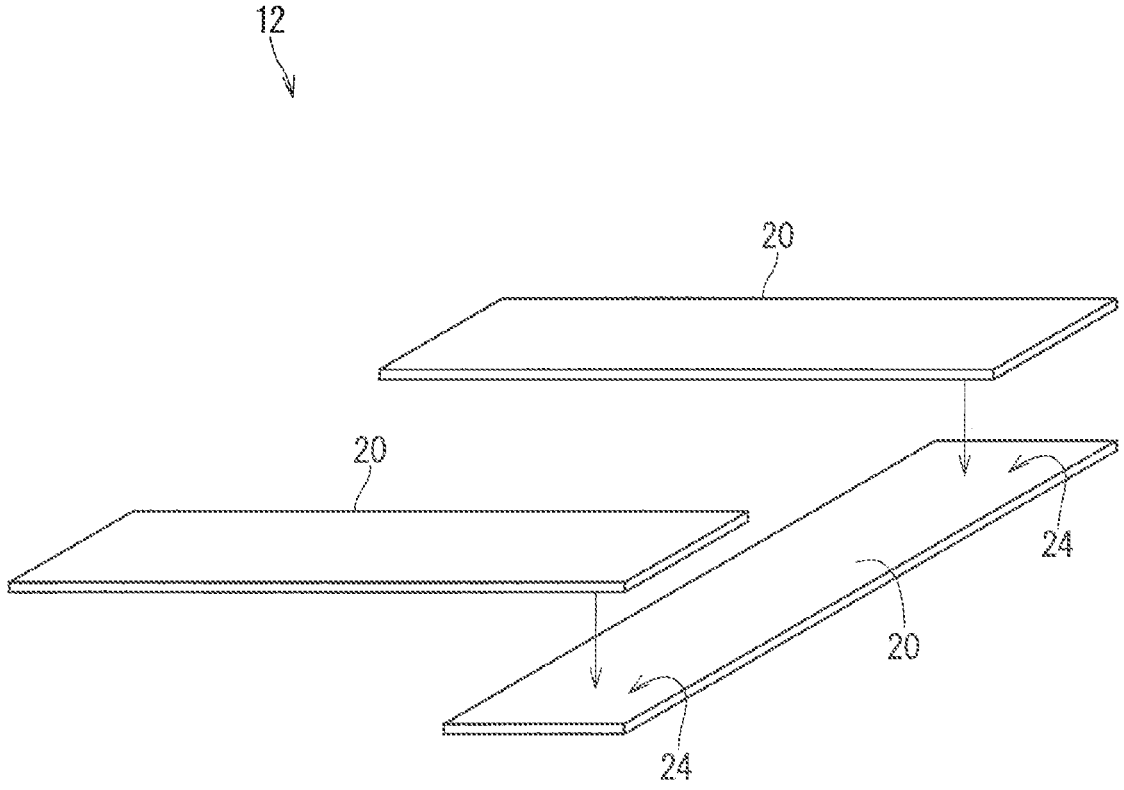
FIG. 3 is a perspective view illustrating a formation of a sheet material according to the first embodiment.

A wiring member according to a first embodiment is described hereinafter. FIG. 1 is a plan view illustrating a wiring member 10 according to the first embodiment. FIG. 2 is a cross-sectional view of the wiring member 10 cut along a II-II line in FIG. 1. FIG. 3 is a perspective view illustrating a formation of a sheet material 12 according to the first embodiment.

The wiring member 10 is a member joined to a component mounted to the vehicle to transmit electrical power or light to and/or from the component. The wiring member 10 includes a sheet material 12 and a wire-like transmission member 30 fixed on the sheet material 12. The wiring member 10 is flatly formed.

The sheet material 12 keeps the plurality of wire-like transmission members 30 in a flat state. The sheet material 12 is processed into a nonlinear shape to extend to regions different from each other. That is to say, the sheet material 12 is processed to extend to a linear first region and a second region deviating from the first region. Herein, the plurality of linear regions intersect with each other and extend in the sheet material 12, thus the sheet material 12 extends to the regions different from each other. The plurality of linear region in the sheet material 12 is referred to as an extension part 14 hereinafter. That is to say, the sheet material 12 includes the plurality of extension parts 14 formed to extend in directions intersecting with each other. The two extension parts 14 adjacent to each other in the plurality of extension parts 14 can be deemed as first and second extension parts 15 and 16.

The sheet material 12 is made by folding one base material 20 or combining a plurality of base materials 20 and processing one base material 20 or the plurality of base materials 20 to extend to regions different from each other. Herein, a state where the base material extends to regions different from each other indicates a state where a folded part or a combined part is not completely overlapped. In the sheet material 12, a wire-like transmission member 30 is fixed to each portion where one base material 20 is folded or the plurality of base materials 20 are combined to extend to the regions different from each other. In the sheet material 12, the portion where one base material 20 is folded or the plurality of base materials 20 are combined to extend to the regions different from each other may include a bent part, a branched part, a part where a width dimension changes, a portion linearly extending with the same width dimension in the sheet material 12, for example. Accordingly, the sheet material 12 includes a base material-combined part 24 which is a portion where one base material 20 is folded and combined or a portion where the plurality of base materials 20 are combined. Herein, the sheet material 12 includes a portion where the plurality of base materials 20 are combined to extend to the regions different from each other. Accordingly, the base material-combined part 24 is the portion where the plurality of base materials 20 are combined.

Specifically, the sheet material 12 is formed by combining the three base materials 20. The base materials 20 are each provided to intersect with each other. Thus, the sheet material 12 includes the three extension parts 14. This three extension parts 14 are referred to as a first extension part 15, a second extension part 16, and a third extension part 17 in some cases hereinafter.

Herein, the base materials 20 are combined in a form of being overlapped with each other. More specifically, the base materials 20 are overlapped with each other in the base material-combined part 24. The portion were the base materials 20 are overlapped with each other is fixed. The fixation of the base materials 20 is described in detail hereinafter.

Herein, the base materials 20 are combined in a position of each end portion. Thus, the base material-combined part 24 is provided on the end portion of the base material 20. Needless to say, there may be a case where the base materials 20 are combined in a position other than the end portion, that is to say, an intermediate portion. This case is described in detail hereinafter.

Herein, the three or more base materials 20 are combined to be continuously arranged. Thus, the two or more base material-combined parts 24, more specifically, the base material-combined parts 24 fewer than the base materials 20 by one in number are provided, and the two base materials 20 are combined in each base material-combined part 24. Needless to say, the three or more base materials 20 may be combined not to be continuously arranged even in a case where they are combined. That is to say, the three or more base materials 20 may also be combined in one base material-combined part. In this case, the base material 20 is considered to be branched in the base material-combined part where the three or more base materials 20 are combined.

Herein, the base materials 20 are combined to be perpendicular to each other. Needless to say, there may also be a case where the base materials 20 are not perpendicular to each other. It is sufficient that the base materials 20 are combined at a desired angle ranging from 0 to 180 degrees.

A material constituting the base material 20 is not particularly limited, but may contain resin such as polyvinyl chloride (PVC), polyethylene (PE), polyethylene terephthalate (PET), and polypropylene (PP), for example, or may contain metal such as aluminum or copper. A structure of the base material 20 is not particularly limited, however, a fiber material having fibers such as a woven cloth, a knitted cloth, and a non-woven cloth, for example, may be applicable, and a non-fiber material which does not have fibers such as a member made up by extrusion molding or injection molding may also be applicable. When the base material 20 is a non-fiber material made up by extrusion molding or injection molding, a foam made up by foam molding or a solid material which is not foam-molded but is uniformly solid may also be applicable. The plurality of base materials 20 may be formed of the same material and have the same structure, or may be formed of different materials and have different structures.

Each base material 20 may have only a single layer or a plurality of layers. When the base material 20 has a plurality of layers, a material and a structure in each layer can be appropriately set. For example, the base material 20 may be made up of a resin layer and a resin layer overlapped with each other, a resin layer and a metal layer overlapped with each other, or a metal layer or a metal layer overlapped with each other. The base material 20 may be made up of a non-fiber material layer and a non-fiber material layer overlapped with each other, a non-fiber material layer and a fiber material layer overlapped with each other, or a fiber material layer and a fiber material layer overlapped with each other.

Herein, each base material 20 is formed into a rectangular shape, however, this configuration is not necessary. The base material 20 may have the other shape such as a trapezoidal shape, a parallelogram shape, or a square shape, for example. The base material 20 is preferably formed into a shape being able to be cut out from a parent material easily. In combining the plurality of base materials 20, the base materials 20 having different shapes may be combined.

Herein, each base material 20 is formed into a shape having the same width dimension and length dimension, however, this configuration is not necessary. It is also considered that the base material 20 having different width dimensions or length dimensions are combined.

It is sufficient that the wire-like transmission member 30 is a wire-like member transmitting electrical power or light. For example, the wire-like transmission member 30 may be a general wire having a core wire and an insulating covering around the core wire, or may also be a bare conductive wire, an enamel wire, a nichrome wire, or an optical fiber.

The wire-like transmission member 30 transmitting the electrical power may be various kinds of signal lines or various kinds of power lines. The wire-like transmission member 30 transmitting the electrical power may be used as an antenna or coil, for example, transmitting or receiving a signal or electrical power to or from a space.

The wire-like transmission member 30 is considered to include a transmission wire body 36 transmitting electrical power or light and a covering 38 covering the transmission wire body 36. When the wire-like transmission member 30 is a general wire, for example, the transmission wire body 36 corresponds to a core wire, and the covering 38 corresponds to an insulating covering. The core wire includes one or a plurality of strands. Each strand is formed of a conductive material such as copper, copper alloy, aluminum, and aluminum alloy, for example. When the core wire is made up of the plurality of strands, the plurality of strands are preferably stranded. The insulating covering is formed of a resin material such as PVC or PE extrusion-molded around the core wire.

The wire-like transmission member 30 in the example illustrated in FIG. 1 is a wire-like transmission member with a bent part 31 bent and disposed to range from the first extension part 15 to the second extension part 16. Furthermore, in the example illustrated in FIG. 1, the wire-like transmission member with the bent part 31 is also bent to range from the second extension part 16 to the third extension part 17.

The fixation of the sheet material 12 and the wire-like transmission member 30 and the fixation of the base materials 20 in the wiring member 10 are described herein. In the example illustrated in FIG. 1, fixing parts FP1, FP2, and FP3 are formed in the wiring member 10. The fixing part FP1 is a part where the sheet material 12 and the wire-like transmission member 30 are fixed to each other. The fixing part FP2 is a part where the sheet material 12 and the wire-like transmission member 30 are fixed to each other, and the base materials 20 are fixed. In the fixing part FP2, a portion where the base materials 20 are overlapped with each other are fixed in the base material-combined part 24. The fixing part FP3 is a part where the base materials 20 are fixed. More specifically, in the fixing part FP3, a portion where the base materials 20 are overlapped with each other is fixed in the base material-combined part 24. In FIG. 1, positions of the fixing parts FP1, FP3, and FP3 are marked with a circular shape, a triangular shape, and a quadrangular shape for simplifying a recognition of the fixing parts FP1, FP2, and FP3, however, a difference in a shape is just for convenience sake, so that a fixing region of each of the fixing parts FP1, FP2, and FP3, for example, is not formed into this shape.

Applicable as the fixing state of the sheet material 12 and the wire-like transmission member 30 in the fixing part FP1 and the fixing part FP2 may be a contact area fixation and a non-contact area fixation, or both fixations may be used together. Herein, the contact area fixation indicates that a portion where the sheet material 12 and the wire-like transmission member 30 have contact with each other is stuck and fixed. The non-contact area fixation indicates the fixing state which is not the contact area fixation. For example, a sewing thread, the other sheet material, or an adhesive tape presses the wire-like transmission member 30 toward the sheet material 12, or sandwiches the sheet material 12 and the wire-like transmission member 30 to keep them in the fixing state. In the description hereinafter, the wire-like transmission member 30 and the sheet material 12 are in the state of the contact area fixation.

Applicable as the configuration of the contact area fixation are a contact area indirect fixation and a contact area direct fixation, or both fixations may also be used together in regions different from each other. Herein, the contact area indirect fixation indicates that the wire-like transmission member 30 and the sheet material 12 are indirectly stuck and fixed via an adhesive agent, a gluing agent, and a double-sided adhesive tape provided therebetween. The contact area direct fixation indicates that the wire-like transmission member 30 and the sheet material 12 are directly stuck and fixed without an intervention of the adhesive agent, for example, which is separately provided. Considered in the contact area direct fixation is that resin included in at least one of the wire-like transmission member 30 and the sheet material 12 is melted, thus the wire-like transmission member 30 and the sheet material 12 are stuck and fixed, for example. In the description hereinafter, the wire-like transmission member 30 and the sheet material 12 are in the state of the contact area direct fixation.

In forming the state of such a contact area direct fixation, the resin is considered to be melted by heat or a solvent, for example. That is to say, the state of the contact area direct fixation may be the state of the contact area direct fixation by the heat or the state of the contact area direct fixation by the solvent. The contact area direct fixation by the heat is preferable.

At this time, a means of forming the state of the contact area direct fixation is not particularly limited, but a known means such as welding, fusion, and melting joint can be used. For example, when the state of the contact area direct fixation by the heat is formed by welding, various welding means such as ultrasonic welding, heating-pressurizing welding, hot air welding, and high frequency welding can be adopted. When the state of the contact area direct fixation is formed by these means, the wire-like transmission member 30 and the sheet material 12 are in the state of the contact area direct fixation by these means. Specifically, when the state of the contact area direct fixation is formed by the ultrasonic welding, for example, the wire-like transmission member 30 and the sheet material 12 are in the state of the contact area direct fixation by the ultrasonic welding.

In the case of the contact area direct fixation, only one of the resin included in the covering 38 of the wire-like transmission member 30 and the resin included in the sheet material 12 may be melted, or both of them may be melted. In the former case, the resin which has been melted is stuck on an outer surface of the resin which has not been melted, and a relatively clear interface may be formed in some cases. In the latter case, there may be a case where both the resins are mixed and a clear interface is not be formed. Particularly, when the covering 38 of the wire-like transmission member 30 and the sheet material 12 include compatible resin such as the same resin material, for example, there may be a case where both the resins are mixed and a clear interface is not be formed.

With regard to a fixing region of the sheet material 12 and the wire-like transmission member 30, in the example illustrated in FIG. 1, the sheet material 12 and the wire-like transmission member 30 are partially fixed along an extension direction of the wire-like transmission member, however, this configuration is not necessary. The sheet material 12 and the wire-like transmission member 30 may be continuously fixed along the extension direction of the wire-like transmission member. Even in the case where the sheet material 12 and the wire-like transmission member 30 are partially fixed along the extension direction of the wire-like transmission member, a position thereof is not limited to the position illustrated in the drawings. Intervals between adjacent fixation positions and a size of each fixation position, for example, may be appropriately set.

Applicable as the fixing state of the base materials 20 in the fixing part FP2 and the fixing part FP3 may be a contact area fixation and a non-contact area fixation, or both fixations may be used together. Herein, the contact area fixation indicates that a portion where the base materials 20 have contact with each other is stuck and fixed. The non-contact area fixation is a fixing state which is not the contact area fixation, and indicates that a sewing thread, the other sheet material, an adhesive tape, or a stapler presses the base materials 20 or sandwiches the base materials 20 to keep them in a fixing state. In the description hereinafter, the base materials 20 are in the state of the contact area fixation.

Applicable as the configuration of the contact area fixation are a contact area indirect fixation and a contact area direct fixation, or both fixations may also be used together in regions different from each other. Herein, the contact area indirect fixation indicates that the base materials 20 are indirectly stuck and fixed via an adhesive agent, a gluing agent, and a double-sided adhesive tape provided therebetween. The contact area direct fixation indicates that the base materials 20 are directly stuck and fixed without an intervention of the adhesive agent, for example, which is separately provided. Considered in the contact area direct fixation is that resin included in at least one of the two base materials 20 is melted, thus the base materials 20 are stuck and fixed, for example. In the description hereinafter, the base materials 20 are in the state of the contact area direct fixation.

In forming the state of such a contact area direct fixation, the resin is considered to be melted by heat or a solvent, for example. That is to say, the state of the contact area direct fixation may be the state of the contact area direct fixation by the heat or the state of the contact area direct fixation by the solvent. The contact area direct fixation by the heat is preferable.

At this time, a means of forming the state of the contact area direct fixation is not particularly limited, but a known means such as welding, fusion, and melting joint can be used. For example, when the state of the contact area direct fixation by the heat is formed by welding, various welding means such as ultrasonic welding, heating-pressurizing welding, hot air welding, and high frequency welding can be adopted. When the state of the contact area direct fixation is formed by these means, the base materials 20 are in the state of the contact area direct fixation by these means. Specifically, when the state of the contact area direct fixation is formed by the ultrasonic welding, for example, the base materials 20 are in the state of the contact area direct fixation by the ultrasonic welding.

in the case of the contact area direct fixation, only one of the resin included in the two base materials 20 may be melted, or both of them may be melted. In the former case, the resin which has been melted is stuck on an outer surface of the resin which has not been melted, and a relatively clear interface may be formed in some cases. In the latter case, there may be a case where both the resins are mixed and a clear interface is not be formed. Particularly, when the two base materials 20 include compatible resin such as the same resin material, for example, there may be a case where both the resins are mixed and a clear interface is not be formed.

With regard to the fixing region of the base material 20, a part of the portion where the two base materials 20 are overlapped with each other is partially fixed in the example illustrated in FIG. 1, however, this configuration is not necessary. The portion where the two base materials are overlapped with each other may be wholly fixed. Also in the case where the part of the portion where the two base materials 20 are overlapped with each other is partially fixed, a position thereof is not limited to that illustrated in the drawings. It is preferable that a corner or an edge, for example, of the portion where the two base materials 20 are overlapped with each other is fixed.

In this manner, all of the fixing parts FP1, FP2, and FP3 are fixed by the contact area direct fixation. Thus, there is a portion where the fixing state of the portion where the base materials 20 are combined and the fixing state of fixing the sheet material 12 to the wire-like transmission member 30 are the same as each other. Specifically, in the example illustrated in FIG. 1, the fixing part FP3 and the fixing part FP1 are in the same fixing state. The fixing state of the base material 20 in the fixing part FP2 and the fixing state of fixing the sheet material 12 to the wire-like transmission member 30 in the fixing part FP2 are the same as each other. The fixing state of the fixing part FP2 and the fixing state of fixing the sheet material 12 to the wire-like transmission member 30 in the fixing part FP2 are the same as each other. The fixing state of the base materials 20 in the fixing part FP2 and the fixing state of the fixing part FP1 are the same as each other.

Furthermore, all of the fixing parts FP1, FP2, and FP3 are fixed by the contact area direct fixation, thus the base materials 20 are fixed by the contact area direct fixation in the portion where the base materials 20 are overlapped with each other, and in the same position as this, the sheet material 12 and the wire-like transmission member 30 are fixed by the contact area direct fixation. Specifically, in the example illustrated in FIG. 1, the fixing state of the base material 20 in the fixing part FP2 is the contact area direct fixation and the fixing state of fixing the sheet material 12 to the wire-like transmission member 30 in the fixing part FP2 is the contact area direct fixation.

<Manufacturing Method>

A method of manufacturing the wiring member 10 is described next.

The method of manufacturing the wiring member 10 includes the following Step (a) to Step (c). Herein, the method of manufacturing the wiring member 10 further includes the following Step (d).

Step (a) is a step of folding one base material 20 or combining a plurality of base materials 20 to form the sheet material 12 processed to extend to regions different from each other. Herein, the plurality of base materials 20 are combined to form the sheet material 12 processed to extend in the regions different from each other.

Step (b) is a step of locating the wire-like transmission member 30 on the sheet material 12. Herein, the wire-like transmission member 30 is disposed to extend to the three continuous extension parts 14 in the sheet material 12.

Step (c) is a step of fixing the sheet material 12 and the wire-like transmission member 30. Herein, the sheet material 12 and the wire-like transmission member 30 are fixed to each other by a contact area direct fixation by ultrasonic welding, for example.

Step (d) is a step of fixing the portion where the base materials 20 are overlapped with each other. Herein, the base materials 20 are fixed by the contact area direct fixation by ultrasonic welding, for example.

At this time, Step (c) and Step (d) are considered to be performed by the same fixing means in the portion where the base materials 20 are overlapped with each other. Specifically, as illustrated by a virtual line in FIG. 2, it is considered that a horn 80 and an anvil 82 sandwich the two base materials 20 and the wire-like transmission member 30 to perform ultrasonic welding. Accordingly, the base materials 20 are fixed by the contact area direct fixation and the sheet material 12 and the wire-like transmission member 30 are fixed to each other by the contact area direct fixation in the same position to form the fixing part FP2 described above. The ultrasonic welding is also performed in positions corresponding to the positions of the fixing part FP1 and the fixing part FP3 described above, respectively, to form the fixing part FP1 and the fixing part FP3 described above. The fixing parts FP1, FP2, and FP3 are formed in this manner to form the wiring member 10.

According to the wiring member 10 having the above configuration and the method of manufacturing the wiring member 10, the one base material 20 is folded or the plurality of base materials 20 are combined to form the sheet material 12 extending to the regions different from each other. A base material formed into a shape having a higher yield than a shape of the sheet material 12 such as a band-like shape is used as this base material 20, thus a yield can be increased at a time of forming the sheet material 12 where the wire-like transmission member 30 is disposed.

The sheet material 12 includes a portion where the plurality of base materials 20 are combined to extend to the regions different from each other. Accordingly, the sheet material 12 can be processed into a desired shape.

The sheet material 12 includes the first extension part 15 and the second extension part 16 formed by folding one base material 20 or combining the plurality of base materials 20 to be formed to extend in directions intersecting with each other. Accordingly, the sheet material 12 having a bent part can be simply obtained.

The wire-like transmission member 30 includes the wire-like transmission member with the bent part 31 bent and disposed to range from the first extension part 15 to the second extension part 16. As described above, a yield can be increased when the sheet material 12 where the portion in which the wire-like transmission member 30 is bent is disposed is formed.

The portion where the base materials 20 are combined is fixed, thus the base materials 20 are hardly misaligned mutually.

There is a portion where the fixing state of the portion where the base materials 20 are combined and the fixing state of fixing the sheet material 12 to the wire-like transmission member 30 are the same as each other. Accordingly, the fixation of the base material 20 and the fixation of the sheet material 12 and the wire-like transmission member 30 can be performed using the same material or apparatus.

The base materials 20 are fixed by the contact area direct fixation in the portion where the base materials 20 are overlapped with each other, and in the same position as this, the sheet material 12 and the wire-like transmission member 30 are fixed by the contact area direct fixation. Accordingly, the fixation of the base materials 20 and the fixation of the sheet material 12 and the wire-like transmission member 30 can be performed by one step. A lead time can be reduced in the fixation of the base materials 20 and the fixation of the sheet material 12 and the wire-like transmission member 30 by performing the fixation by the same fixing means at this time.

Second Embodiment

Figure 4:
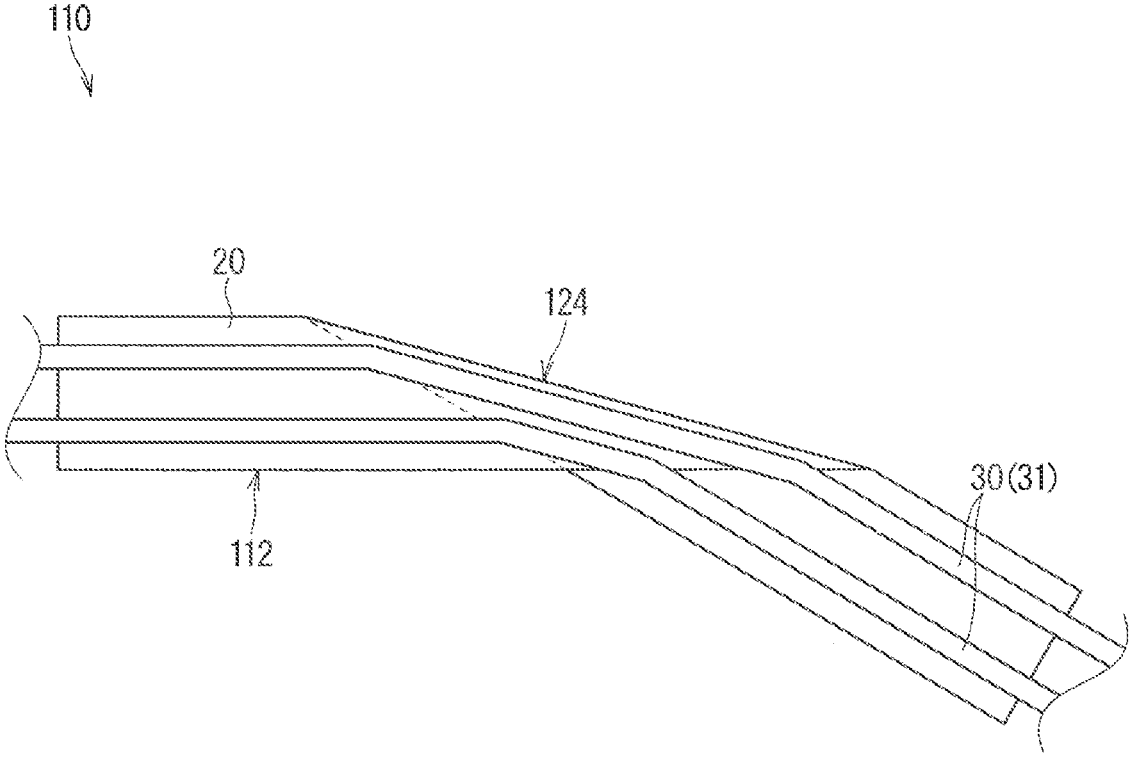
FIG. 4 is a plan view illustrating a wiring member according to a second embodiment.
Figure 5:
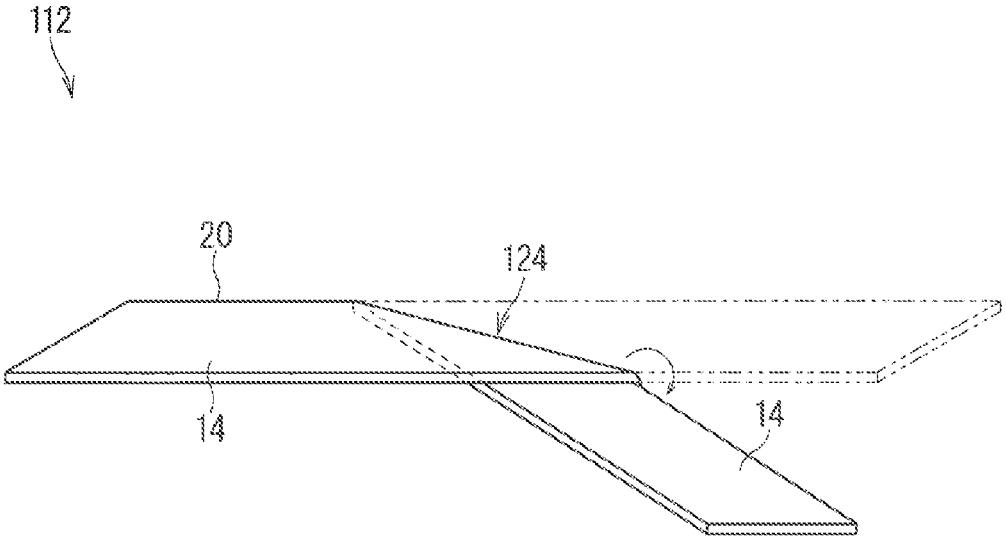
FIG. 5 is a perspective view illustrating a formation of a sheet material according to the second embodiment.

A wiring member according to a second embodiment is described. FIG. 4 is a plan view illustrating a wiring member 110 according to the second embodiment. FIG. 5 is a perspective view illustrating a formation of a sheet material 112 according to the second embodiment. In the following description of the present embodiment, the same reference numerals are assigned to the similar constituent elements described above, and the description thereof will be omitted. The illustration of the fixing parts FP1, FP2, and FP3 is omitted. The same applies to the description of each embodiment hereinafter.

A shape of a sheet material 112 in the wiring member 110 is different from that of the sheet material 12 in the wiring member 10. Specifically, the sheet material 112 includes a portion where one base material 20 is folded to extend to regions different from each other. When one base material 20 is folded to form the sheet material 112, a portion of both sides of a fold line along which the base material 20 is folded is normally overlapped with other in a base material-combined part 24.

The sheet material 112 is formed by folding the base material 20 once so that one main surface of the base material 20 is directed inward (referred to as a valley fold hereinafter). Accordingly, both main surfaces of the base material 20 appear in one main surface of the sheet material 112. More specifically, in the example illustrated in FIG. 5, the two extension parts 14 are formed in the sheet material 112. One main surface of one of the two extension parts 14 is mainly made up of one main surface of the base material 20, and one main surface of the other one of the two extension parts 14 is mainly made up of the other main surface of the base material 20.

In the example illustrated in FIG. 5, when the base material 20 is seen from a side of the other main surface thereof, the base material 20 is formed by being folded once so that the other main surface of the base material 20 is directed outward (referred to as a mountain fold hereinafter). At this time, it is optionally set which main surface is directed inward when the valley fold is performed. Accordingly, a way to fold the base material 20 m times by the valley fold and n times by the mountain fold (m and n are each integral number equal to or larger than 0 and at least one of them is a natural number) is deemed to be substantially the same as a way to fold the base material 20 n times by the valley fold and m times by the mountain fold.

The sheet material formed by folding the base material 20 may be formed by folding the base material 20 by the other way.

For example, the sheet material may be formed by folding the base material 20 several times by the valley fold. Specifically, two fold lines L1 and L2 are formed in the base material 20 illustrated in FIG. 6. At this time, the valley fold is performed at both of the two fold lines L1 and L2, thus the sheet material folded to include the two extension parts 14 intersecting with each other (perpendicular to each other in the example illustrated in FIG. 6) is obtained.

Figure 6:
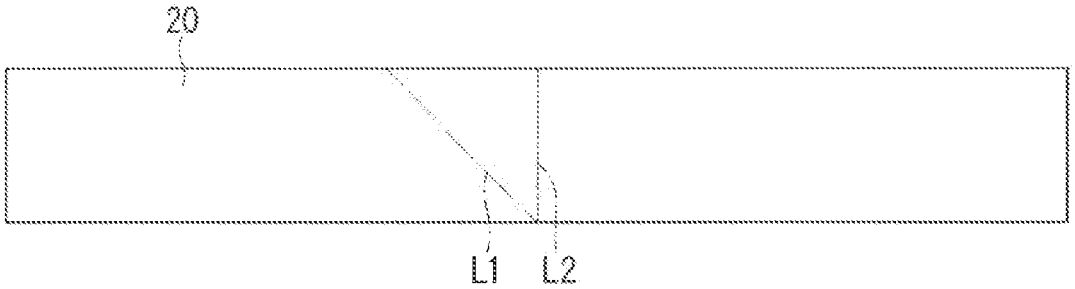
FIG. 6 is an explanation drawing illustrating a modification example of a way to fold a base material.

In this case, particularly in the example illustrated in FIG. 6, the both main surfaces of the base material 20 appear in one main surface in the sheet material, and only the other main surface of the base material 20 appears in the other main surface in the sheet material. Accordingly, when there is one main surface on which the wire-like transmission member 30 is intended to be disposed in the base material 20, it is sufficient that the valley fold is performed so that the other main surface on a side opposite to one main surface is directed inward. Formed in the portion where the base materials 20 are overlapped with each other are a portion where one main surface and one main surface of the base materials 20 are overlapped to face each other and a portion where one main surface and the other main surface of the base materials 20 are overlapped to face each other.

For example, the sheet material may also be formed by being folded at least once by both the valley fold and the mountain fold. Specifically, in the base material 20 illustrated in FIG. 6, the valley fold is performed at one of the two fold lines L1 and L2, and the mountain fold is performed at the other one of them, thus the sheet material folded to include the two extension parts 14 intersecting with each other (perpendicular to each other in the example illustrated in FIG. 6) is also obtained.

In this case, particularly in the example illustrated in FIG. 6, only one main surface of the base material 20 appears in one main surface in the sheet material, and only the other main surface of the base material 20 appears in the other main surface in the sheet material. Accordingly, when there is a main surface on which the wire-like transmission member 30 is intended to be disposed in the base material 20, the main surface appears on one of the main surfaces of the sheet material. Formed in the portion where the base materials 20 are overlapped with each other are a portion where one main surface and one main surface of the base materials 20 are overlapped to face each other and a portion where the other main surface and the other main surface of the base materials 20 are overlapped to face each other.

Figure 7:
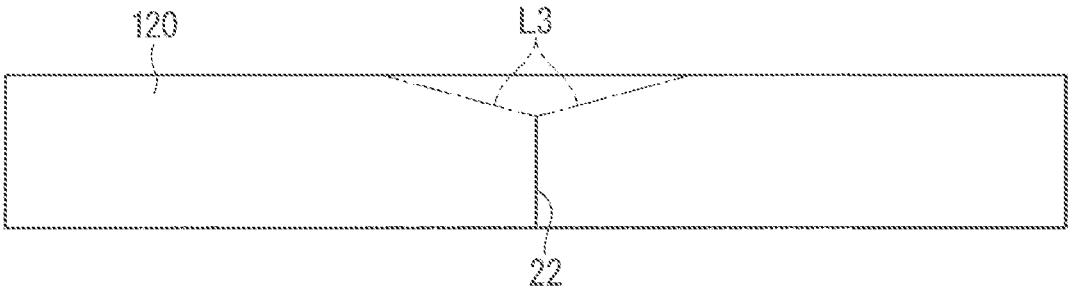
FIG. 7 is an explanation drawing illustrating a modification example of a way to fold the base material.

For example, a slit may be appropriately formed in a position to be folded in the base material 20. Specifically, in the example illustrated in FIG. 7, a slit 22 is formed from one side edge toward an intermediate portion in a width direction of the base material 120. A portion of the base material 120 separated by this slit 22 is overlapped and folded along the fold line L3, thus the sheet material folded to include the two extension parts 14 intersecting with each other (having an obtuse angle in the example illustrated in FIG. 7) is obtained.

When the sheet material 112 includes the portion where one base material 20 is folded extend to regions different from each other as described above, increase in the number of base materials 20 can be suppressed.

Third Embodiment

Figure 8:
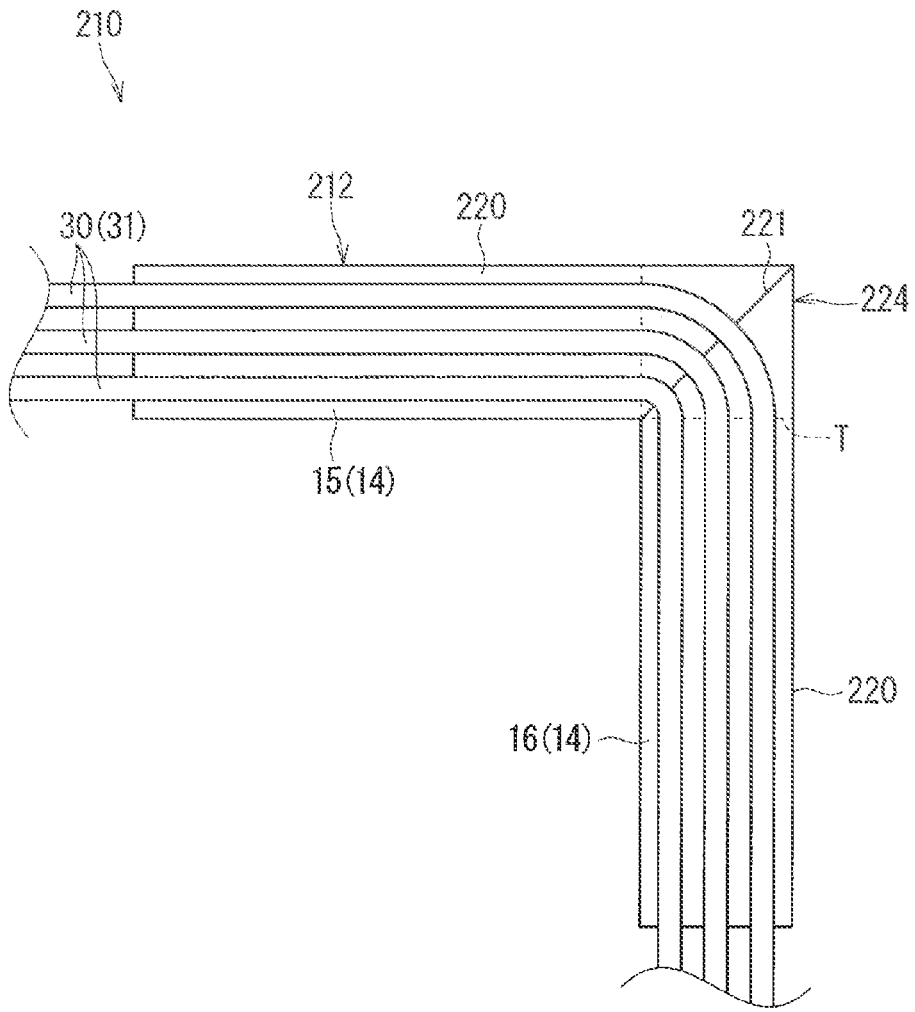
FIG. 8 is a plan view illustrating a wiring member according to a third embodiment.
Figure 9:
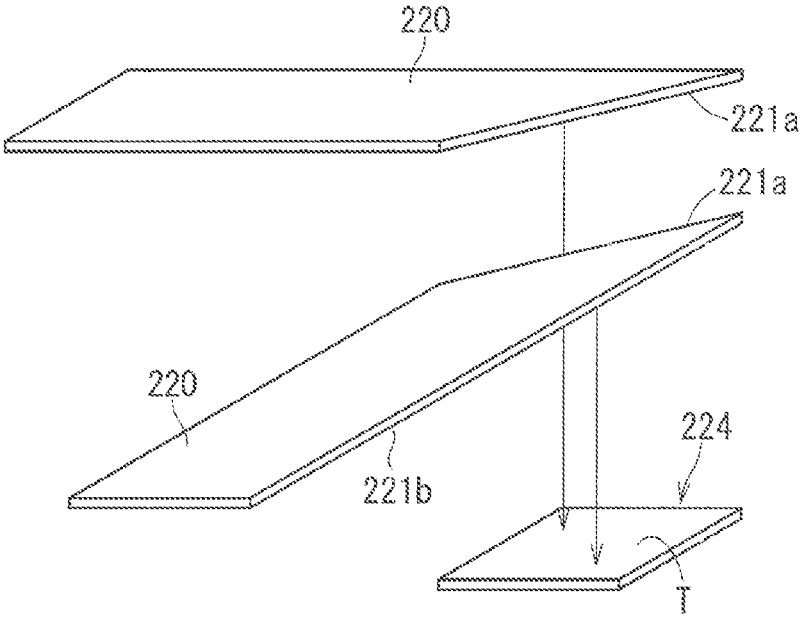
FIG. 9 is a perspective view illustrating a formation of a sheet material according to the third embodiment.

A wiring member according to a third embodiment is described. FIG. 8 is a plan view illustrating a wiring member 210 according to the third embodiment. FIG. 9 is a perspective view illustrating a formation of a sheet material 212 according to the third embodiment.

In the description described above, the base materials 20 are overlapped with each other in the base material-combined part 24, however, this configuration is not necessary. Base materials 220 are not overlapped but independently arranged in a base material-combined part 224 as with a wiring member 210 illustrated in FIG. 8. In this case, edge portions of the base materials 220 preferably butt against each other.

In the example illustrated in FIG. 8, the two base materials 220 each having a side 221*a*, which has vertexes of acute angle and obtuse angle at both ends, are arranged so that the sides 221*a* butt against each other, thus the sheet material 212 having the two extension parts 14 intersecting with each other is formed without the overlap of the base materials 220. The two base materials 220 have the same acute angle in the above description, but may be formed to have different angles.

Such base materials 220 are formed by cutting a band-like parent material at an acute angle with an extension direction of the parent material, for example.

When the two base materials 220 are arranged as with the example in FIG. 8, a sum of the acute angles is equal to an angle between an extension direction of the first extension part 15 and an extension direction of the second extension part 16. Particularly when the two base materials 220 have the same acute angle and the acute angle of the base material 220 is smaller than 45 degrees, an angle between the extension direction of the first extension part 15 and the extension direction of the second extension part 16 becomes an acute angle. When the acute angle of each base material 220 is 45 degrees, the angle between the extension direction of the first extension part 15 and the extension direction of the second extension part 16 becomes right angle. When the acute angle of each base material 220 is larger than 45 degrees, the angle between the extension direction of the first extension part 15 and the extension direction of the second extension part 16 becomes an obtuse angle.

Needless to say, a shape of the base material 220 and an arrangement form of the base material 220 are not limited thereto described above. For example, the trapezoidal base material 220 illustrated in FIG. 8 may also be arranged in an arrangement form other than that in FIG. 8. For example, when the base materials 220 are arranged so that the side 221*a* described above of one of the trapezoidal base materials 220 butts against a bottom side 221*b* of the other one of the trapezoidal base materials 220 and the obtuse angle of one of the trapezoidal base materials 220 butts against the acute angle of the other one of the trapezoidal base materials 220, the two base materials 220 (extension part 14) intersect with each other at an angle of 135 degrees. For example, when the base materials 220 are arranged so that the side 221*a* of one of the trapezoidal base materials 220 butts against the bottom side 221*b* of the other one of the trapezoidal base materials 220 and the acute angle of one of the trapezoidal base materials 220 butts against the acute angle of the other one of the trapezoidal base materials 220, the two base materials 220 (extension part 14) intersect with each other at an angle of 45 degrees.

For example, it is also considered that the base materials are arranged so that the side 221*a* of the trapezoidal base material 220 illustrated in FIG. 8 butts against a long side of the rectangular base material 20 illustrated in FIG. 3.

When the base materials 220 are not overlapped but combined in the base material-combined part 224, the base materials 220 may be or may not be fixed to each other. When the base materials 220 are fixed to each other, a fixing means thereof is not particularly limited.

In the example illustrated in FIG. 9, the two base materials 220 are fixed to each other by a fixing member. More specifically, a part of each base material 220 is attached to an adhesive tape T, thus the two base materials 220 are fixed to each other. Herein, when the sheet material 212 and the wire-like transmission member 30 are fixed by the contact area direct fixation in the manner similar to the first embodiment, there is a portion in which a fixing state of a portion where the base materials 220 are combined and a fixing state of fixing the sheet material 212 to the wire-like transmission member 30 are different from each other. In such a case, a fixing structure appropriate for each of the fixation of the base materials 220 and the fixation of the sheet material 212 and the wire-like transmission member 30 can be adopted.

Considered as the example of the fixation of the base materials 220 which are combined without the overlap other than the above example is that a thread is sewn or a stapler is locked across the two base materials 220 in a portion where the two base materials 220 butt against each other to fix the two base materials 220. For example, it is also considered that a portion where the two base materials 220 butt against each other and the wire-like transmission member 30 disposed across the portion are integrally fixed by a contact area fixation.

When the base materials 220 are combined without the overlap to form the sheet material 212 in this manner, a level difference is hardly formed in the portion where the wire-like transmission member 30 is disposed across the plurality of base materials 220. Increase in a thickness dimension of the sheet material 212 can be suppressed by reason that the base materials 220 are not overlapped with each other.

Fourth Embodiment

Figure 10:
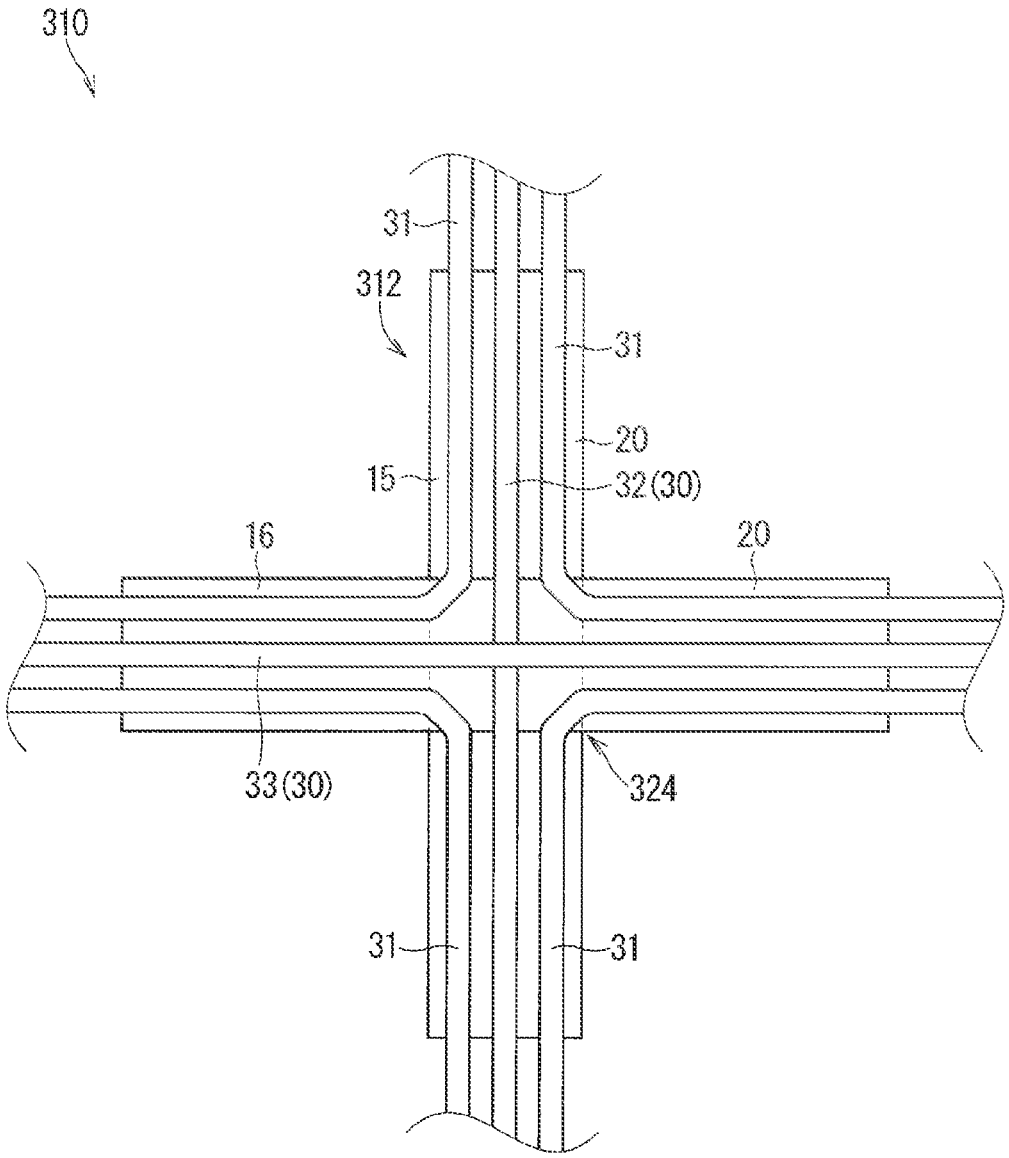
FIG. 10 is a plan view illustrating a wiring member according to a fourth embodiment.
Figure 11:
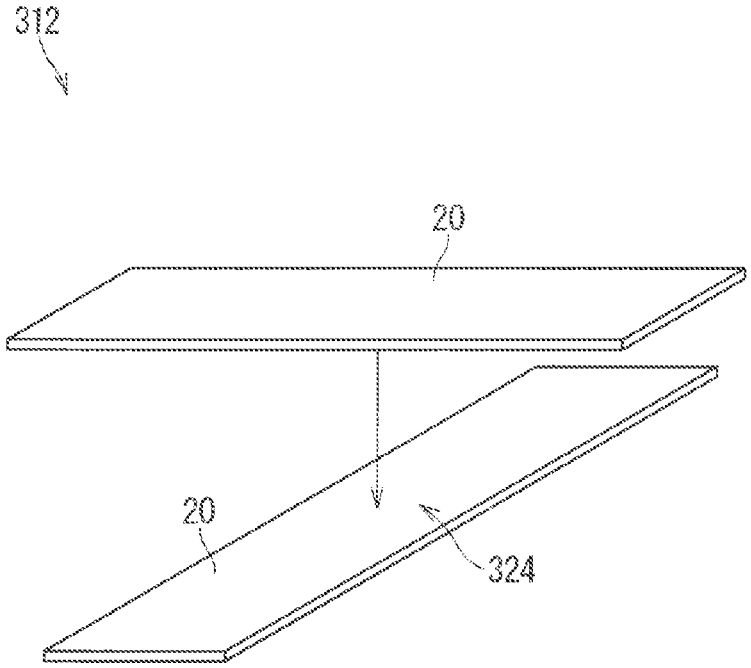
FIG. 11 is a perspective view illustrating a formation of a sheet material according to the fourth embodiment.

A wiring member according to a fourth embodiment is described. FIG. 10 is a plan view illustrating a wiring member 310 according to the fourth embodiment. FIG. 11 is a perspective view illustrating a formation of a sheet material 312 according to the fourth embodiment.

A shape of the sheet material 312 and an arrangement form of the wire-like transmission member 30 in the wiring member 310 are different from the shape of the sheet materials 12, 112, and 212 and the arrangement form of the wire-like transmission member 30 in the wiring members 10, 110, and 210 described above.

With regard to the sheet material 312, the plurality of base materials 20 are combined in an intermediate portion. In the example illustrated in FIG. 10, the two base materials 20 are combined in each intermediate portion. Thus, the sheet material 312 has an X shape and a branch is formed in the sheet material 312. A base material-combined part 324 is formed in the middle of the base material 20.

Alternatively considered is that an end portion of one of the two base materials 20 and an intermediate portion of the other one of the two base materials 20 are combined. Also in this case, a branch is formed in the sheet material.

With regard to the wire-like transmission member 30, in the above description, the wire-like transmission member 30 is the wire-like transmission member with the bent part 31 bent and disposed to range from the first extension part 15 to the second extension part 16, however, this configuration is not necessary. There may be a case where the wire-like transmission members 30 are linearly disposed on each of the first extension part 15 and the second extension part 16 and intersect with each other as with the wiring member 310 illustrated in FIG. 10. That is to say, the wire-like transmission member 30 includes a first wire-like transmission member 32 extending along the first extension part 15 and a second wire-like transmission member 33 extending along the second extension part 16 and intersecting with the first wire-like transmission member 32. In the example illustrated in FIG. 10, the wire-like transmission member with the bent part 31 bent and disposed across the plurality of extension parts 14 are also disposed as the wire-like transmission member 30. It is also considered that only the first wire-like transmission member 32 and the second wire-like transmission member 33 are disposed as the wire-like transmission member 30.

According to such a wiring member 310, a yield can be increased when the sheet material 312 where the portion in which the wire-like transmission members 30 intersect with each other is disposed is formed.

Fifth Embodiment

Figure 12:
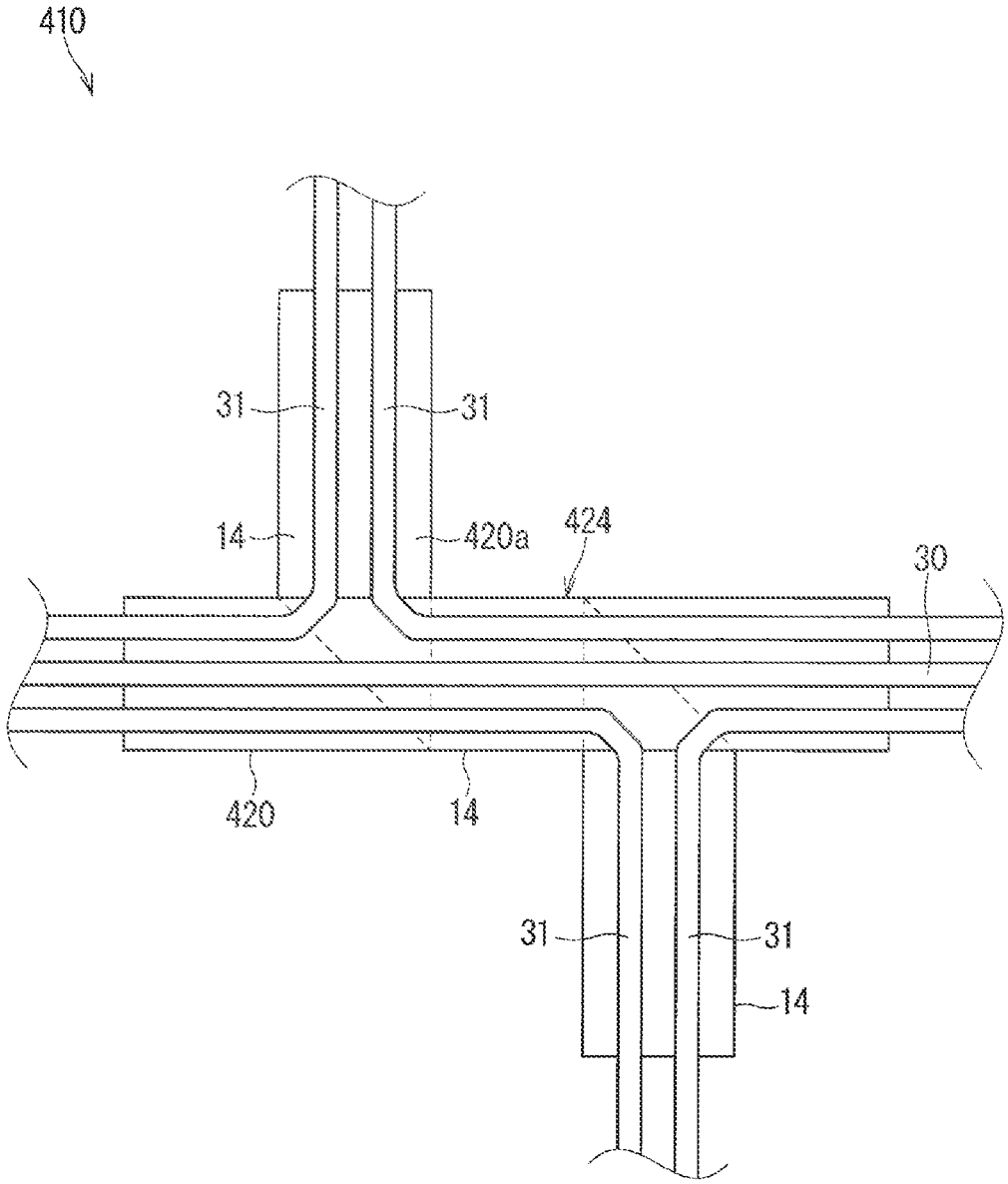
FIG. 12 is a plan view illustrating a wiring member according to a fifth embodiment.
Figure 13:
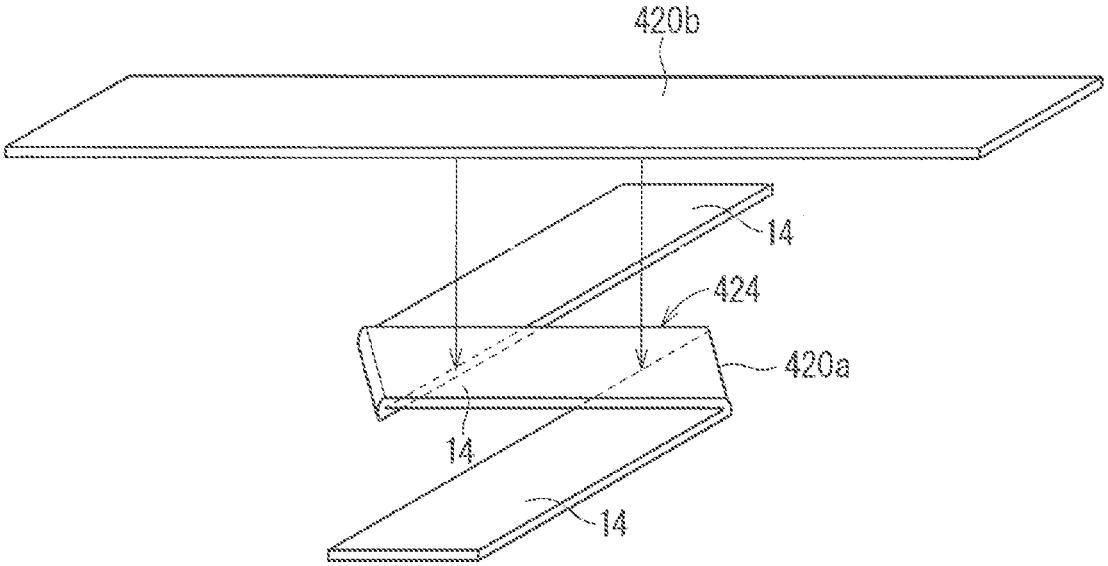
FIG. 13 is a perspective view illustrating a formation of a sheet material according to the fifth embodiment.

A wiring member according to a fifth embodiment is described. FIG. 12 is a plan view illustrating a wiring member 410 according to the fifth embodiment. FIG. 13 is a perspective view illustrating a formation of a sheet material 412 according to the fifth embodiment.

In the description described above, only one of the configuration that one base material is folded and the configuration that the plurality of base materials are combined in the sheet material is adopted, however, this configuration is not necessary. There may be a case where both the configuration that one base material is folded and the configuration that the plurality of base materials are combined in the sheet material 412 are adopted at the same time as with the wiring member 410 illustrated in FIG. 12. That is to say, it is also considered that the plurality of base materials are combined and at least one of the base materials are folded to form the sheet material 412.

Specifically, the sheet material 412 is formed by combining two base materials 420*a* and 420*b* in the example illustrated in FIG. 12. At this time, one of the base materials 420*a* is folded to include the three extension parts 14 intersecting with each other. The other one of the base materials 420*b* is not folded, but an intermediate portion thereof is overlapped with the extension part 14 in the middle of the folded base material 420*a*. Thus, the sheet material 412 includes one base material-combined part 424. A branch is formed in two positions in the sheet material 412.

The folded base material 420*a* and the plurality of base materials 420*a* and 420*b* combined with each other are used together in this manner, thus the sheet material 412 having a complex shape is obtained.

Sixth Embodiment

Figure 14:
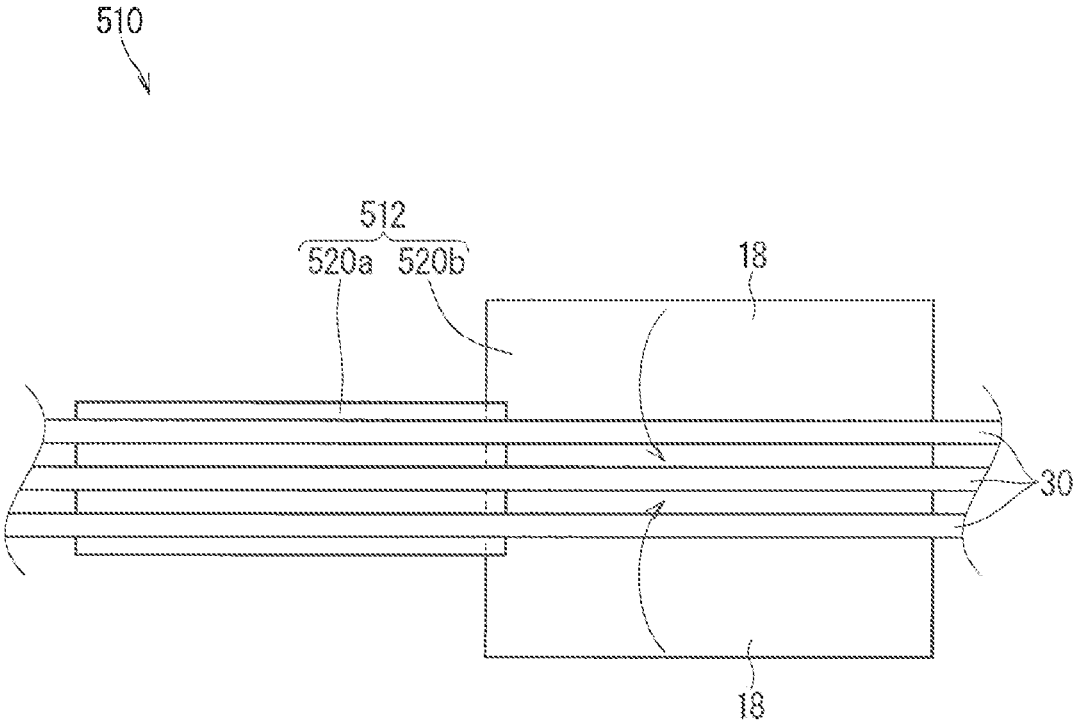
FIG. 14 is a plan view illustrating a wiring member according to a sixth embodiment.

A wiring member according to a sixth embodiment is described. FIG. 14 is a plan view illustrating a wiring member 510 according to the sixth embodiment.

In the description described above, there is a case where the wire-like transmission member 30 bent or intersects is disposed on the sheet material, however, this configuration is not necessary. There may also be a case where the plurality of wire-like transmission members 30 are just linearly disposed in parallel to each other on a sheet material 512 as with a wiring member 510 illustrated in FIG. 14.

When the plurality of wire-like transmission members 30 are just linearly disposed in parallel to each other on the sheet material 512 in this manner, there is a redundant part 18 where the wire-like transmission member 30 is not disposed in the sheet material 512 in a flat state as illustrated in FIG. 14. The redundant part 18 is considered to be used to wrap the wire-like transmission member 30, for example. Formed accordingly is the wiring member 510 in which the wire-like transmission member 30 is wrapped with the sheet material 512 in a part of a region along a longitudinal direction and only one side of the wire-like transmission member 30 is covered by the sheet material 512 in the other part of the region. Also considered alternatively is that a fixing member for assembling the wiring member 510 to a vehicle is attached to the redundant part 18, for example.

Herein, the first base material 520*a* and the second base material 520*b* are arranged to extend in the same direction, and a width dimension of the second base material 520*b* is larger than a width dimension of the first base material 520*a*, thus the sheet material 512 extends to regions different from each other. Accordingly, the regions different from each other in this case example indicates one linear region and a region extending in a width direction thereof.

The wire-like transmission member 30 is disposed to extend along a direction, in which the first base material 520*a* and the second base material 520*b* are arranged, on these base materials 520*a* and 520*b*. Accordingly, the redundant part 18 where the wire-like transmission member 30 is not disposed is formed in the second base material 520*b*.

Needless to say, also adoptable is a sheet material including the plurality of extension parts 14 made by folding one base material or combining the plurality of base materials to extend in directions intersecting with each other. In this case, the wire-like transmission member 30 is disposed only on a part of the extension part 14 in the sheet material, thus the other extension part 14 becomes the redundant part 18 where the wire-like transmission member 30 is not disposed.

Seventh Embodiment

Figure 15:
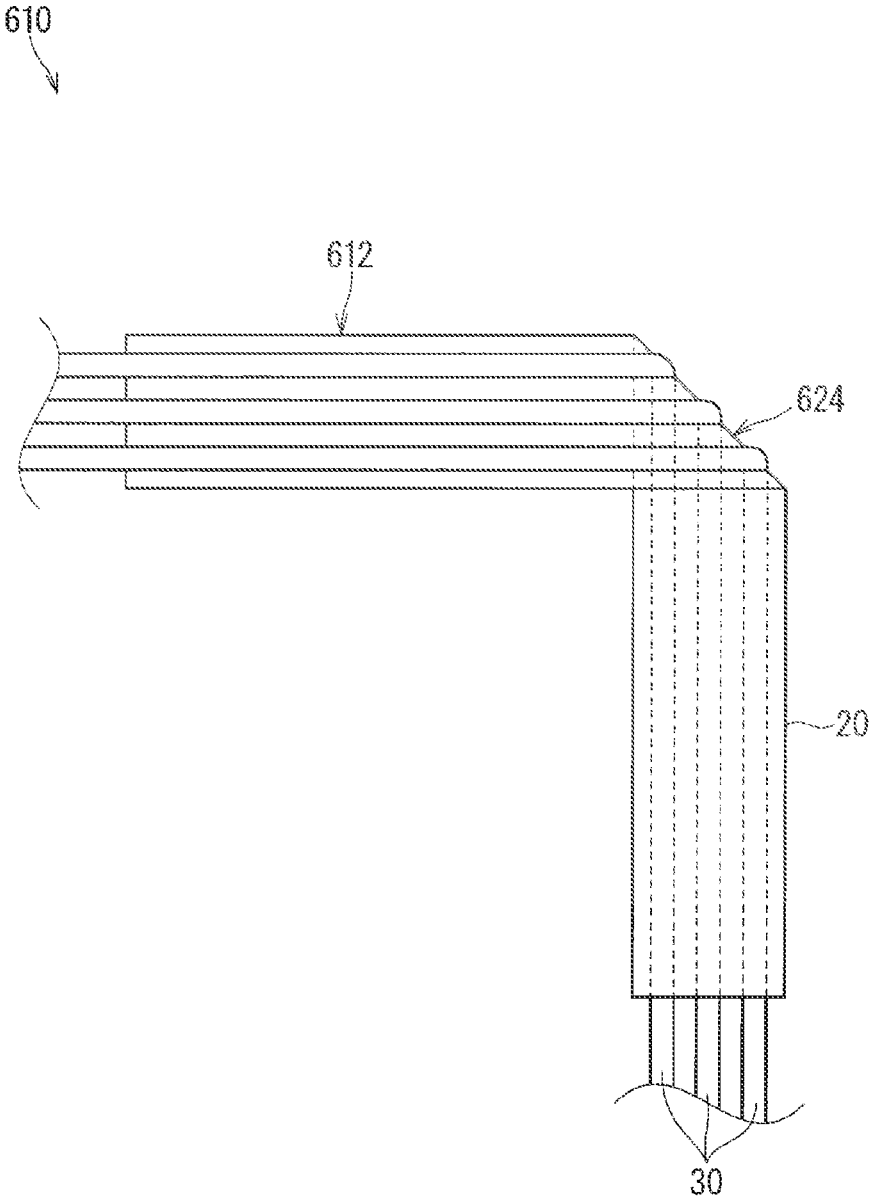
FIG. 15 is a plan view illustrating a wiring member according to a seventh embodiment.
Figure 16:
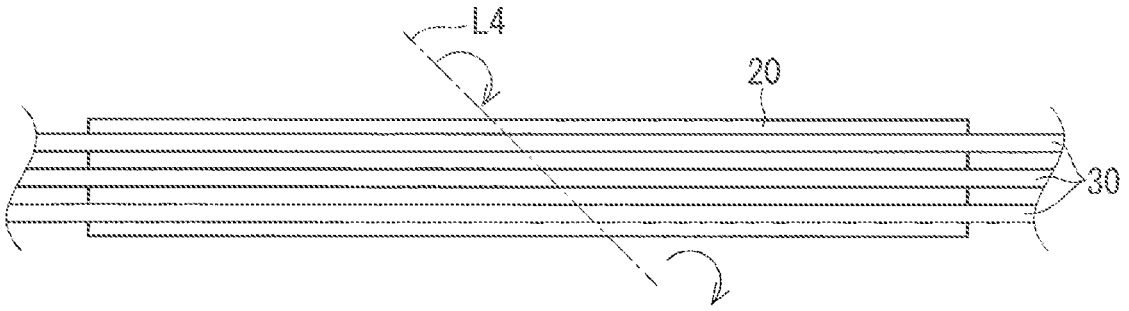
FIG. 16 is a perspective view illustrating a formation of the wiring member according to the seventh embodiment.

A wiring member according to a seventh embodiment is described. FIG. 15 is a plan view illustrating a wiring member 610 according to the seventh embodiment. FIG. 16 is a perspective view illustrating a formation of the wiring member 610 according to the seventh embodiment.

In the above description, the wire-like transmission member 30 is disposed on one main surface of the sheet material, however, this configuration is not necessary. There may also be a case where the wire-like transmission member 30 passes from one main surface to the other main surface of the sheet material 612 as with the wiring member 610 illustrated in FIG. 15.

Such a wiring member 610 is formed by folding the base material 20 together with the wire-like transmission member 30 along a fold line L4 in a state where the wire-like transmission member 30 is disposed and fixed on one main surface of the base material 20 as illustrated in FIG. 16, for example. In this case, the wire-like transmission member 30 passes from one main surface to the other main surface of the sheet material 612 in the base material-combined part 624. Herein, a mountain fold is performed so that the surface where the electrical wire is disposed is directed outward in the base material 20, however, a valley fold may be performed so that the surface where the electrical wire is disposed is directed inward in the base material 20.

Needless to say, it is also applicable that the sheet material 612 is formed by folding one base material or combining the plurality of base materials, and subsequently, the wire-like transmission member 30 is disposed to pass from one main surface to the other main surface of the sheet material 612 to form the wiring member 610.

Eighth Embodiment

Figure 17:
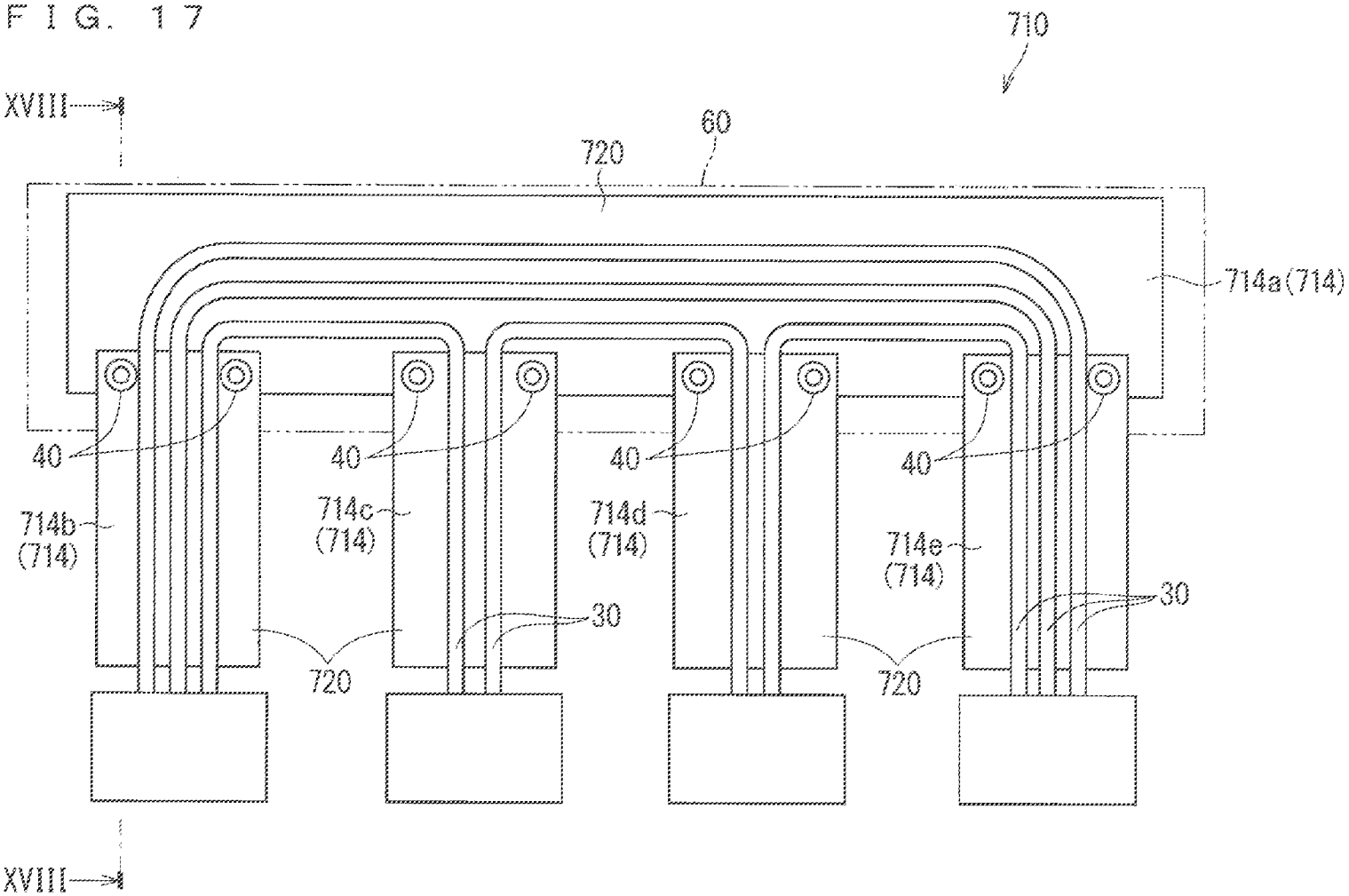
FIG. 17 is a plan view illustrating a wiring member according to an eighth embodiment.
Figure 18:
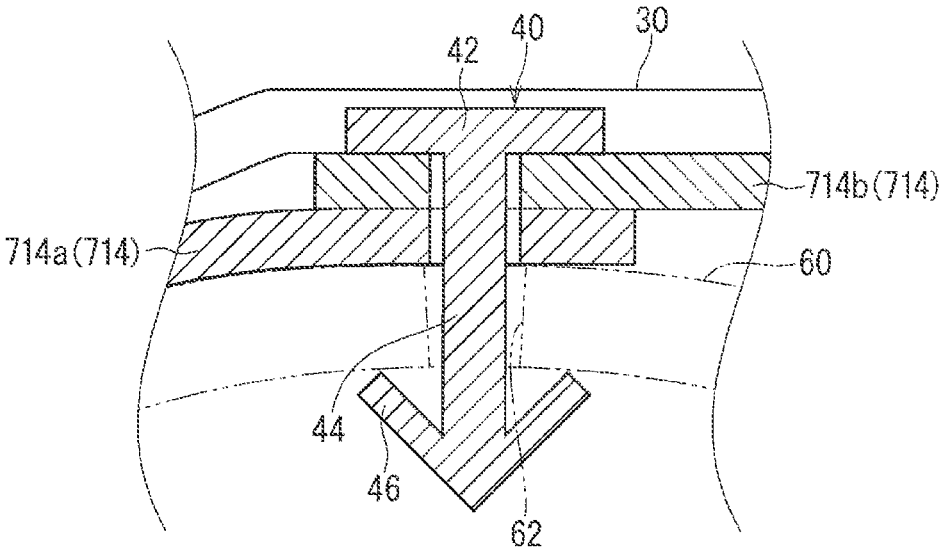
FIG. 18 is a partially schematic cross-sectional view of the wiring member cut along a XVIII-XVIII line in FIG. 17.

A wiring member according to an eighth embodiment is described. FIG. 17 is a plan view illustrating a wiring member 710 according to the eighth embodiment. FIG. 18 is a partially schematic cross-sectional view of the wiring member 710 cut along a XVIII-XVIII line in FIG. 17.

A sheet material of the wiring member 710 includes a plurality of extension parts 714. A base material 720 constituting the extension part 714 is formed to have directionality in a tensile strength. The wire-like transmission member 30 is disposed on the extension part 714 to extend along a direction in which the tensile strength of the base material 720 is strong.

In the example illustrated in FIG. 17, four extension parts 714*b*, 714*c*, 714*d*, and 714*e* extend in parallel to each other from one extension part 714*a*. The extension part 714*a* and one of the extension parts 714*b*, 714*c*, 714*d*, and 714*e* can be deemed as a first extension part and a second extension part.

Herein, the wire-like transmission members 30 are disposed to extend along a direction in which the tensile strength of the base material 720 is strong in all of the extension parts 714. When there is three or more extension parts 714, it is sufficient that the wire-like transmission members 30 are disposed to extend along a direction in which the tensile strength of the base material 720 is strong in at least one pair of the extension parts 714 adjacent to each other.

In the example illustrated in FIG. 17, a major part of the wire-like transmission members 30 extend on the extension part 714*a* along the direction in which the tensile strength of the base material 720 is strong, and a part of the wire-like transmission members 30 are bent and extend toward the extension parts 714*b*, 714*c*, 714*d*, and 714*e*. As with this case, even in a case where the wire-like transmission member 30 are bent or intersect with each other on one extension part 714, when the major part of the wire-like transmission members 30 extend on the extension part 714 along the direction in which the tensile strength of the base material 720 constituting the extension part 714 is strong, the wire-like transmission member 30 can be deemed to be disposed on the extension part 714 to extend along the direction in which the tensile strength of the base material 720 is strong.

The base material 720 is not particularly limited, however, the various types of base materials 720 having directionality in a tensile strength can be adopted. Specifically, a long-fibered non-woven cloth can be used as the base material 720 having have directionality in a tensile strength, for example. More specifically, the long-fibered non-woven cloth is normally formed so that long fibers extend in a warp direction (also referred to as a machine direction or a MD, for example). Thus, a tensile strength in the warp direction is larger than a tensile strength in a cross direction (also referred to as a CD, for example) intersecting with the warp direction in the long-fibered non-woven cloth.

A stretched film such as a uniaxial stretched film and a biaxial stretched film, for example, can also be used as the base material 720 having directionality in a tensile strength. More specifically, the tensile strength of the stretched film normally increases when the stretched film is stretched. Accordingly, a degree of stretch between the warp direction and the cross direction is changed, thus the stretched film having directionality in a tensile strength can be obtained.

For example, a base material provided with a shape changing a tensile strength can also be used as the base material 720 having directionality in a tensile strength. An embossed part can be adopted to one side as the shape changing the tensile strength, for example. More specifically, a plurality of embossed parts elongated in one side are formed in a zigzag arrangement in a uniform sheet-like member. At this time, the plurality of embossed parts are located so that their elongated directions are parallel to each other and a space between the adjacent embossed parts along the elongated direction is smaller than a dimension of the embossed part in the elongated direction. Accordingly, a base material in which a tensile strength of the embossed part along the elongated direction is larger than a tensile strength of the embossed part along a short-side direction can be obtained.

The base material 720 is also considered to have directionality in non-stretchability (axial rigidity). In this case, the wire-like transmission member 30 is disposed on the extension part 714 to extend along a non-stretch direction (a high axial-rigidity direction), thus the base material 720 can prevent the wire-like transmission member 30 from being stretched when the wiring member 710 is pulled along the longitudinal direction of the wire-like transmission member 30. The base material 720 is also considered to be formed so that the non-stretch direction and the direction in which the tensile strength is strong coincide with each other. In this case, a function of the base material 720 for protecting the wire-like transmission member 30 is further enhanced when the wiring member 710 is pulled along the longitudinal direction of the wire-like transmission member 30. For example, the long-fibered non-woven cloth, the stretched film, and the base material 720, in which the embossed part elongated in one side is formed, described above, for example, also have directionality in the non-stretchability in many cases, and the non-stretch direction and the direction in which the tensile strength is strong coincide with each other in many cases.

The fixing member 40 for fixing the wiring member 710 to a fixing target is provided in the wiring member 710. Herein, the fixing target is a vehicle, for example. More specifically, the fixing target is a body, a panel, and a reinforcement of a vehicle, for example. In the example illustrated in FIG. 17, a reinforcement 60 is illustrated as the fixing target. It is considered that the reinforcement 60 is a column-like or tubular rod-like member, for example, and an outer surface thereof has a circular shape or a quadrangular shape. A hole 62 for fixing the fixing member 40 is formed in the reinforcement 60.

A clamp including a bottom part 42, a column part 44, and a locking part 46 is adopted as the fixing member 40 herein. The bottom part 42 is formed into a plate-like shape. The column part 44 stand on the bottom part 42. The locking part 46 is provided on a tip end of the column part 44. The locking part 46 is formed to be able to be inserted into and locked to the hole 62 formed in the fixing target. The locking part 46 is inserted into and locked to the hole 62 formed in the fixing target, thus the clamp is fixed to the fixing target. The bottom part 42 functions as a retaining part and the locking part 46 functions as a detent part in the state where the clamp is fixed to the fixing target. The clamp is an integrated molded component made of resin by injection molding, for example.

The fixing member 40 is provided in a portion where the base materials 720 are overlapped with each other in the plurality of extension parts 714. Accordingly, the fixing member 40 is fixed to the fixing target, thus the plurality of extension parts 714 are fixed at the same time. In the example illustrated in FIG. 17, the base material 720 of the extension part 714*a* and the base material 720 of the extension parts 714*b*, 714*c*, 714*d*, and 714*e* are provided in a portion overlapped with each other. There may be a case where a portion closer to a terminal portion side of any of the plurality of extension parts 714 in relation to the fixing member 40 in the wiring member 710 is pulled in the state where the fixing member 40 is fixed to the fixing target. Assumed as such a case is that in assembling the wiring member 710, the fixing member 40 is fixed to the fixing target in advance, and subsequently, the portion closer to the terminal portion side in relation to the position of the fixing member 40 is routed for connecting the terminal portion, for example.

The fixing member 40 is provided in the portion where the base materials 720 of the plurality of extension parts 714 are overlapped with each other and the wire-like transmission member 30 extends along the direction in which the tensile strength of each base material 720 is strong, thus the direction in which the portion of each terminal portion side is pulled in the state where the fixing member 40 is fixed to the fixing target is a direction in which the tensile strength of each base material 720 is strong. Accordingly, suppressed is excessive force on the wire-like transmission member 30. Pulling force applied at the time when the side of any of the extension parts 714 in the wiring member 710 is pulled hardly acts on the other extension part 714 in the state where the fixing member 40 is fixed to the fixing target.

It is also considered that the fixing member 40 locks the base materials 720 of the plurality of extension parts 714. In this case, the plurality of extension parts 714 are easily kept to intersect with each other by the fixing member 40. For example, as illustrated in FIG. 18, it is considered that the column part 44 of the fixing member 40 passes through the base materials 720 of the plurality of extension parts 714 and the base materials 720 of the plurality of extension parts 714 are located between the bottom part 42 and the locking part 46, thus the fixing member 40 locks the base materials 720 of the plurality of extension parts 714. It is alternatively considered that the bottom part 42 of the fixing member 40 is located between the base materials 720 of the plurality of extension parts 714, an outer surface of the bottom part 42 is fixed to the base material 720 of one extension part 714 in the plurality of extension parts 714, and the column part 44 of the fixing member 40 passes through the base material 720 of the other extension part 714 in the plurality of extension parts 714, thus the fixing member 40 locks the base materials 720 of the plurality of extension parts 714, for example. It is considered that the bottom part 42 of the fixing member 40 includes a plurality of plate-like parts, and the plurality of plate-like parts sandwich the base materials 720 of the plurality of extension parts 714 together, thus the fixing member 40 locks the base materials 720 of the plurality of extension parts 714.

According to the wiring member 710 having the above configuration, the wire-like transmission member 30 is disposed in the extension part 714 to extend along the direction in which the tensile strength of the base material 720 is strong, thus easily suppressed is excessive force on the wire-like transmission member 30 when the wiring member 710 is pulled along the longitudinal direction of the wire-like transmission member 30.

The fixing member 40 is provided in the portion where the base materials 720 of the plurality of extension parts 714 are overlapped with each other, thus the base materials 720 of the plurality of extension parts 714 can be fixed together by one fixing member 40. Even when the portion closer to the terminal portion side of any of the plurality of extension parts 714 in relation to the fixing member 40 in the wiring member 710 is pulled in the state where the fixing member 40 is fixed to the fixing target, it is pulled in the direction in which the tensile strength of the base material 720 is strong, thus suppressed is excessive force on the wire-like transmission member 30. Pulling force applied at the time when one extension part 714 in the wiring member 710 is pulled hardly acts on the other extension part 714 in the state where the fixing member 40 is fixed to the fixing target.

In the example illustrated in FIG. 17, the plurality of extension parts 714 are made up of the separated base materials 720, however, one base material 720 is folded to form the plurality of extension parts 714. In this case, it is sufficient that the fixing member 40 is provided in a portion where one base material 720 is folded to be overlapped with each other.

In the example illustrated in FIG. 17, the linear extension part 714*a* continued with the same dimension is made up of one sheet of base material 720. The linear extension part 714*a* continued with the same dimension may be made up of the plurality of base materials combined with each other.

Figure 19:
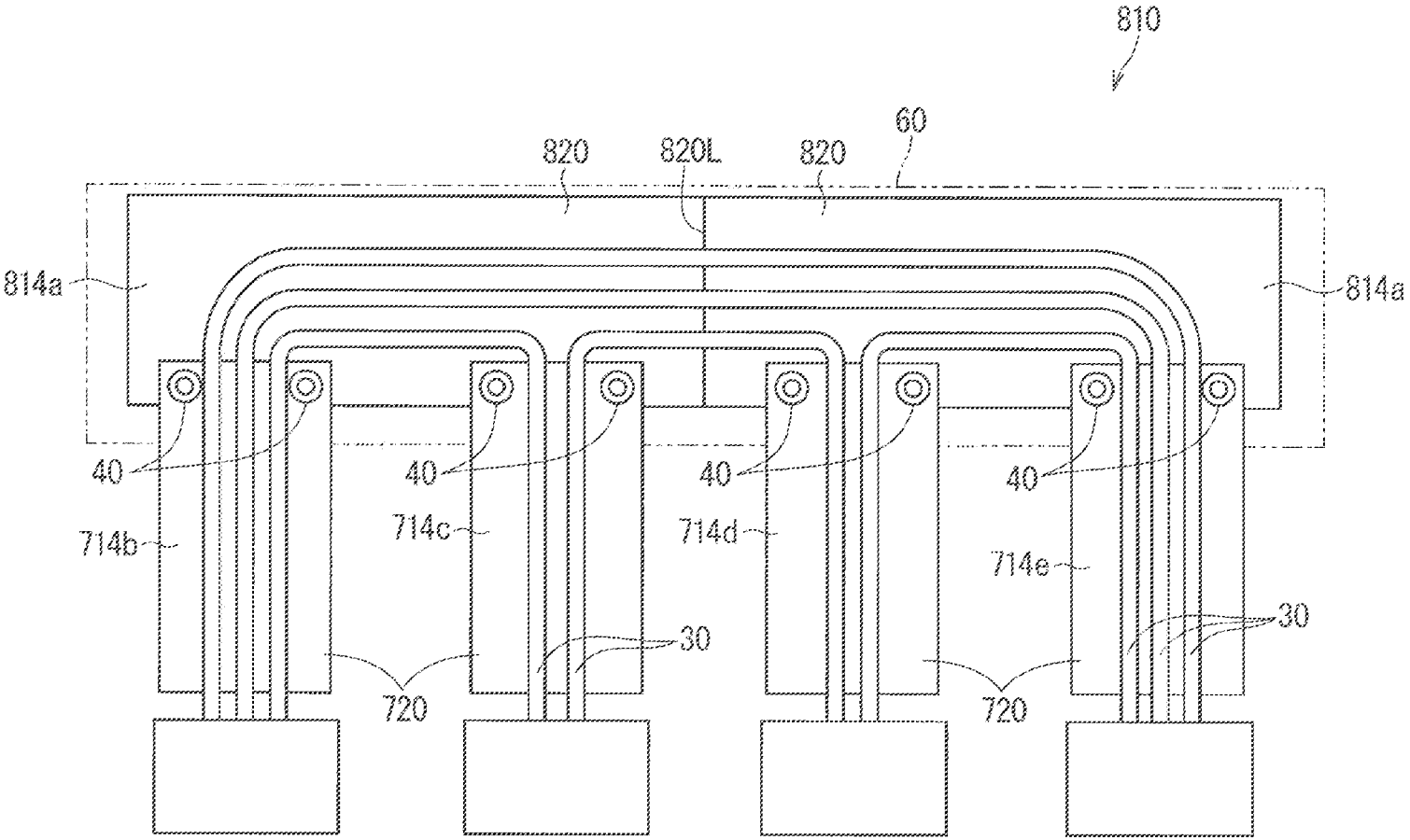
FIG. 19 is a plan view illustrating modification example of the wiring member according to the eighth embodiment.

An example illustrated in FIG. 19 is a modification example of the wiring member 710 according to the eighth embodiment. In a wiring member 810 illustrated in FIG. 19, the linear extension part 814*a* continued with the same width dimension is made up of two base materials 820 combined with each other. The linear extension part 814*a* may be made up of three of more base materials combined with each other. The configuration similar to that of the linear extension part 714*a* can be adopted to the linear extension part 814*a* except for the configuration that the plurality of base materials 820 are combined with each other. The configuration similar to that of the base material 720 can be adopted to the base material 820 except for the configuration that the length dimension is different. As described above, the plurality of base materials 820 are combined to constitute the linear extension part 814*a*, thus a yield can be increased when a portion in which a portion linearly extending is long in the sheet material is formed, for example.

The two base materials 820 have the same length as each other. The two base materials 820 may have lengths different from each other. The portion where the two base materials 820 are fixed to each other is provided in a position deviating from the portion where the base material 720 of any of the other extension parts 714*b*, 714*c*, 714*d*, and 714*e* is fixed to the base material 820. The portion where the two base materials 820 are fixed to each other may be the same as the portion where the base material 720 of any of the other extension parts 714*b*, 714*c*, 714*d*, and 714*e* is fixed to the base material 820. The base material 720 of any of the other extension parts 714*b*, 714*c*, 714*d*, and 714*e* may pass across a joint line 820L between the two base materials 820. The state of fixing the two base materials 820 is not particularly limited, however, various fixing states described above can be appropriately selected, for example.

The fixing member 40 may be omitted. Even in the case where the fixing member 40 is adopted, the configuration of adopting the clamp as the fixing member 40 is not necessary, however, the fixing member 40 such as a bracket for fastening a bolt other than the clamp may be adopted. Even in the case where the fixing member 40 is adopted, a position thereof is not limited to that described above. For example, the fixing member 40 may be provided in each of the extension part 714*a* and the extension parts 714*b*, 714*c*, 714*d*, and 714*c* separately.

Modification Example

The wire-like transmission member with the bent parts 31 may intersect with each other on the sheet material. Similarly, the wire-like transmission member with the bent part 31 and the wire-like transmission member 30 linearly disposed such as the first wire-like transmission member 32 and the second wire-like transmission member 33 may intersect with each other on the sheet material.

When one base material is folded or the plurality of base materials are combined with each other, a slit into which the folded base material or the combined base material is inserted may be formed in the base material.

The configurations described in the embodiments and modification examples thereof can be appropriately combined as long as they are not contradictory. For example, each configuration described in each embodiment and each modification example described above may be adopted in the plurality of positions along the longitudinal direction of one wiring member. For example, the configuration regarding the base material and the fixing member described in the eighth embodiment may be applied to the wiring members according to the first to seventh embodiments.

Although the present invention is described in detail, the foregoing description is in all aspects illustrative and does not restrict the invention. It is therefore understood that numerous modifications and variations can be devised without departing from the scope of the invention.

EXPLANATION OF REFERENCE SIGNS

10 wiring member
12 sheet material
14 extension part
15 first extension part
16 second extension part
20 base material
24 base material-combined part
30 wire-like transmission member
31 wire-like transmission member with bent part
32 first wire-like transmission member
33 second wire-like transmission member
36 transmission wire body
38 covering
FP1, FP2, FP3 fixing part
L1, L2, L3 fold line

The invention claimed is:

1. A wiring member, comprising:

a sheet material made by folding one base material or combining a plurality of base materials and processing the one base material or the plurality of base materials to extend to regions different from each other; and a wire-like transmission member fixed on the sheet material, wherein the wire-like transmission member includes a transmission wire body and a covering for covering the transmission wire body, and is fixed to only the sheet material covering one side of the wire-like transmission member by a contact area fixation, the wire-like transmission member is fixed to each of portions, the portions extend to regions different from each other and formed by folding one base material or combining a plurality of base materials, and the wire-like transmission member is disposed on one main surface of the sheet material from one end to another end of the sheet material, and the sheet material includes a portion where one base material is folded to extend to regions different from each other.

2. The wiring member according to claim 1, wherein the sheet material includes a portion where a plurality of base materials are combined to extend to regions different from each other.

3. The wiring member according to claim 2, wherein the plurality of base materials are combined in a portion linearly extending in the sheet material.

4. The wiring member according to claim 1, wherein the sheet material includes a first extension part and a second extension part formed by folding one base material or combining a plurality of base materials to be formed to extend in directions intersecting with each other.

5. The wiring member according to claim 4, wherein the wire-like transmission member includes a wire-like transmission member with a bent part bent and disposed to range from the first extension part to the second extension part.

6. The wiring member according to claim 1, wherein a portion where the base materials are combined is fixed.

7. The wiring member according to claim 6, wherein there is a portion where a fixing state of a portion in which the base materials are combined and a fixing state of fixing the sheet material to the wire-like transmission member are identical with each other.

8. The wiring member according to claim 7, wherein the base materials are fixed in a portion overlapped with each other by a contact area direct fixation, and the sheet material and the wire-like transmission member are fixed to each other by a contact area direct fixation at a position identical with a position of the portion.

9. The wiring member according to claim 6, wherein there is a portion where a fixing state of a portion in which the base materials are combined and a fixing state of fixing the sheet material to the wire-like transmission member are different from each other.

10. A wiring member comprising:

a sheet material made by folding one base material or combining a plurality of base materials and processing the one base material or the plurality of base materials to extend to regions different from each other; and a wire-like transmission member fixed on the sheet material, wherein the wire-like transmission member includes a transmission wire body and a covering for covering the transmission wire body, and is fixed to only the sheet material covering one side of the wire-like transmission member by a contact area fixation, the wire-like transmission member is fixed to each of portions, the portions extend to regions different from each other and formed by folding one base material or combining a plurality of base materials, and the wire-like transmission member is disposed on one main surface of the sheet material from one end to another end of the sheet material, the sheet material includes a first extension part and a second extension part formed by folding one base material or combining a plurality of base materials to be formed to extend in directions intersecting with each other, the base material constituting each of the first extension part and the second extension part is formed to have directionality in a tensile strength, and the wire-like transmission member is disposed on the first extension part and the second extension part to extend along a direction in which the tensile strength of the base material is strong.

11. The wiring member according to claim 10, wherein the sheet material includes a portion where one base material is folded to extend to regions different from each other.

12. The wiring member according to claim 10, wherein a fixing member for fixing the wiring member to a fixing target is provided in a portion where the base material of the first extension part and the base material of the second extension part are overlapped with each other.

13. A wiring member comprising:

a sheet material made by folding one base material or combining a plurality of base materials and processing the one base material or the plurality of base materials to extend to regions different from each other; and a wire-like transmission member fixed on the sheet material, wherein the wire-like transmission member includes a transmission wire body and a covering for covering the transmission wire body, and is fixed to only the sheet material covering one side of the wire-like transmission member by a contact area fixation, the wire-like transmission member is fixed to each of portions, the portions extend to regions different from each other and formed by folding one base material or combining a plurality of base materials, and the wire-like transmission member is disposed on one main surface of the sheet material from one end to another end of the sheet material, the sheet material includes a first extension part and a second extension part formed by folding one base material or combining a plurality of base materials to be formed to extend in directions intersecting with each other, and the wire-like transmission member includes a first wire-like transmission member extending along the first extension part and a second wire-like transmission member extending along the second extension part to intersect with the first wire-like transmission member.

14. A method of manufacturing a wiring member, comprising:

forming a sheet material processed to extend to regions different from each other by folding one base material or combining a plurality of base materials;

locating the wire-like transmission member on the sheet material; and fixing the sheet material and the wire-like transmission member, wherein the locating and the fixing the sheet material and the wire-like transmission member are performed after the forming of the sheet material, and the wire-like transmission member is disposed on one main surface of the sheet material from one end to another end of the sheet material, and is fixed to only the sheet material covering one side of the wire-like transmission member by a contact area fixation.

15. The method of manufacturing the wiring member according to claim 14, further comprising:

fixing a portion where the base materials are overlapped with each other, wherein the fixing the sheet material and the wire-like transmission member and the fixing the portion are performed by an identical fixing means in the portion where the base materials are overlapped with each other.

16. The method of manufacturing the wiring member according to claim 14, wherein the sheet material is formed by folding one base material, and the locating and the fixing the sheet material and the wire-like transmission member are performed after the folding.

* * * * *